US009443376B2

(12) United States Patent
Vollmann

(10) Patent No.: US 9,443,376 B2
(45) Date of Patent: Sep. 13, 2016

(54) GAMING DEVICE BASE WITH SLIDABLE MOUNTING BRACKETS

(75) Inventor: Colton Vollmann, Henderson, NV (US)

(73) Assignee: VSR Industries, Inc., Henderson, NV (US)

( * ) Notice: Subject to any disclaimer, the term of this patent is extended or adjusted under 35 U.S.C. 154(b) by 589 days.

(21) Appl. No.: 13/204,531

(22) Filed: Aug. 5, 2011

(65) Prior Publication Data

US 2012/0058830 A1 Mar. 8, 2012

Related U.S. Application Data

(60) Provisional application No. 61/379,995, filed on Sep. 3, 2010, provisional application No. 61/480,309, filed on Apr. 28, 2011.

(51) Int. Cl.
*G07F 17/32* (2006.01)

(52) U.S. Cl.
CPC ..... *G07F 17/3216* (2013.01)

(58) Field of Classification Search
CPC ..... G07F 13/3216
USPC ..... 463/1, 17, 20, 46; 273/309
See application file for complete search history.

(56) References Cited

U.S. PATENT DOCUMENTS

| | | | | |
|---|---|---|---|---|
| 5,524,860 | A * | 6/1996 | Ives | 248/674 |
| 5,678,679 | A * | 10/1997 | Berman | 194/344 |
| 6,105,962 | A * | 8/2000 | Malavazos et al. | 273/143 R |
| D472,939 | S * | 4/2003 | Philpott | D21/385 |
| 7,040,626 | B2 * | 5/2006 | Seelig et al. | 273/309 |
| 7,253,803 | B2 * | 8/2007 | Schena et al. | 345/163 |
| 7,316,378 | B1 * | 1/2008 | Curran et al. | 248/298.1 |
| 8,002,637 | B1 * | 8/2011 | Mitchell | 463/46 |
| 2002/0060124 | A1 * | 5/2002 | Thompson | 194/350 |
| 2004/0149866 | A1 * | 8/2004 | Boucher et al. | 248/127 |
| 2005/0087927 | A1 * | 4/2005 | Seelig et al. | 273/143 R |
| 2005/0096137 | A1 * | 5/2005 | Seelig et al. | 463/46 |
| 2008/0100187 | A1 * | 5/2008 | Tomasello et al. | 312/223.6 |
| 2008/0113741 | A1 * | 5/2008 | Beadell et al. | 463/20 |
| 2008/0182642 | A1 * | 7/2008 | Cole | 463/20 |
| 2009/0005147 | A1 * | 1/2009 | Okuaki et al. | 463/16 |
| 2010/0093440 | A1 * | 4/2010 | Burke | 463/42 |
| 2011/0079685 | A1 * | 4/2011 | Kwak | 248/65 |
| 2011/0315850 | A1 * | 12/2011 | Kubach | 248/678 |

FOREIGN PATENT DOCUMENTS

JP H08280924 * 10/1996

* cited by examiner

*Primary Examiner* — Jay Liddle
(74) *Attorney, Agent, or Firm* — Lewis Roca Rothgerber Christie LLP

(57) ABSTRACT

One or more gaming devices, such as slot machines, can be installed onto a gaming device base comprised of façade kits removably attached to a gaming device foundation. The tops of the gaming device bases either have replaceable top surfaces or adjustable attachment points in order to allow different gaming devices to be attached to any given base. In one embodiment of the later, adjustable mounting brackets are utilized that provide elongated bolt hole slots through which bolts can be inserted from a gaming device. The gaming devices are then secured to a base by use of nuts inserted and tightened over the bolts. The adjustable mounting brackets can be slid back and forth when bolts through them have not been secured with nuts. The mounting brackets can also be easily inserted and removed. The result is that the mounting points for gaming devices can be adjusted in two dimensions, allowing for the installation of most gaming devices, regardless of bolt and cable configurations.

20 Claims, 50 Drawing Sheets

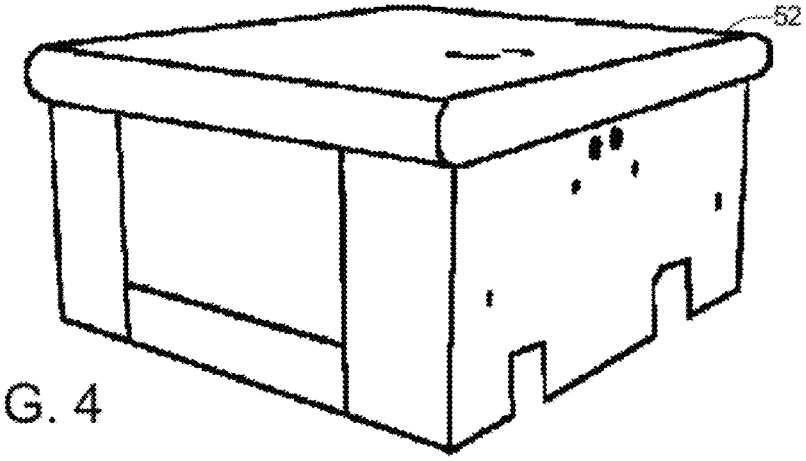
FIG. 4
FIG. 5
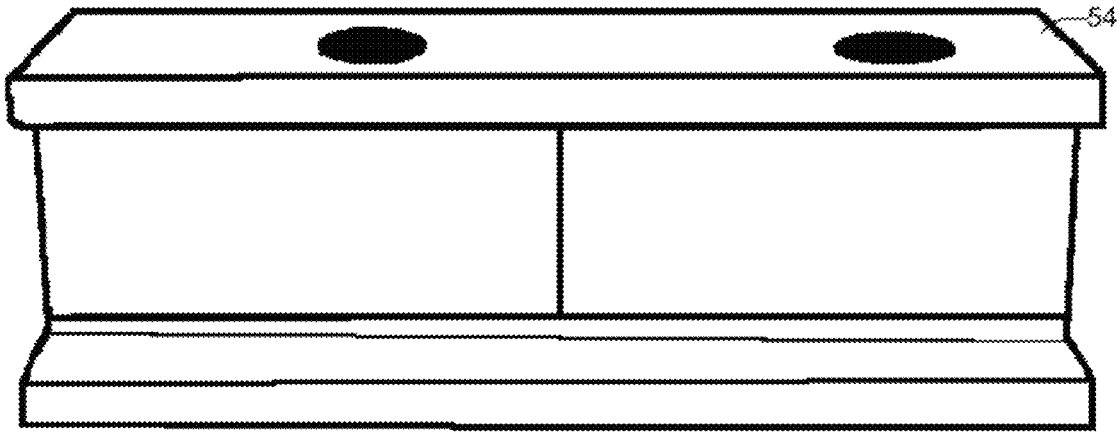
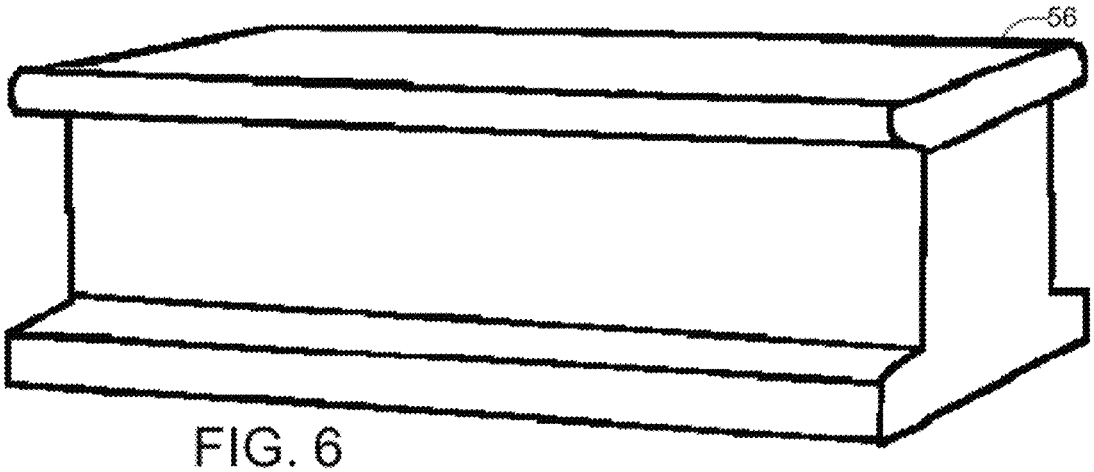
FIG. 6

FIG..7
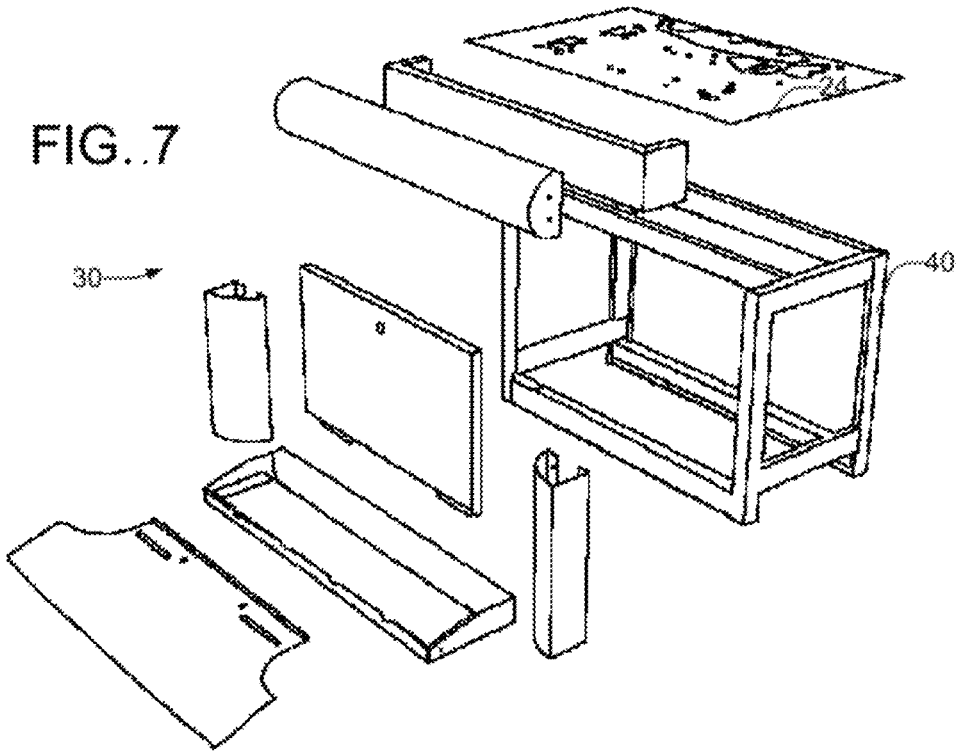
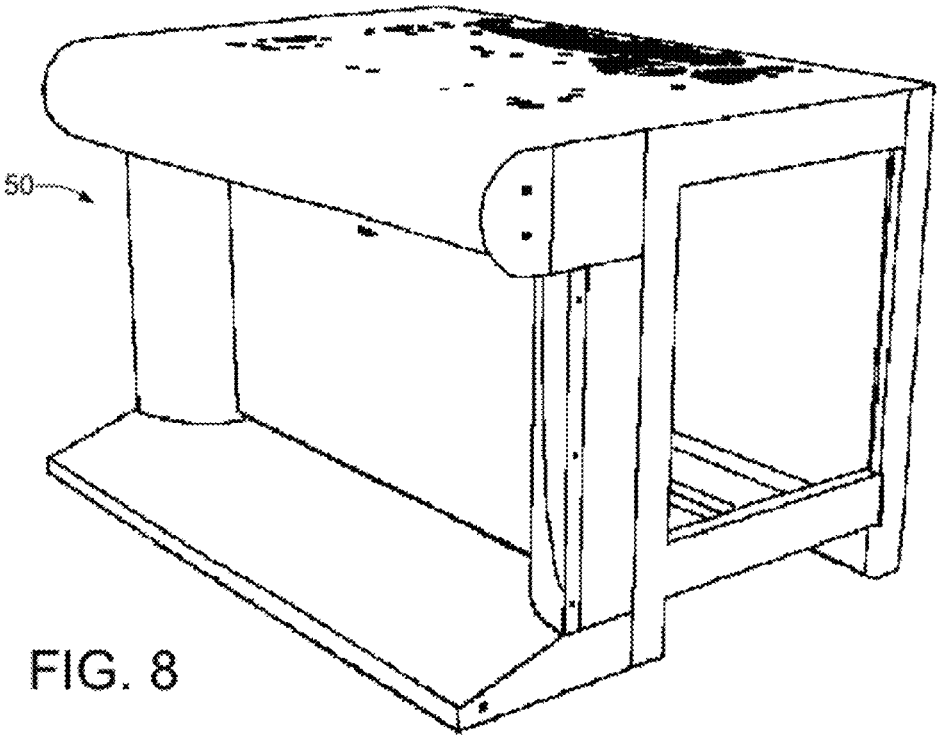
FIG. 8

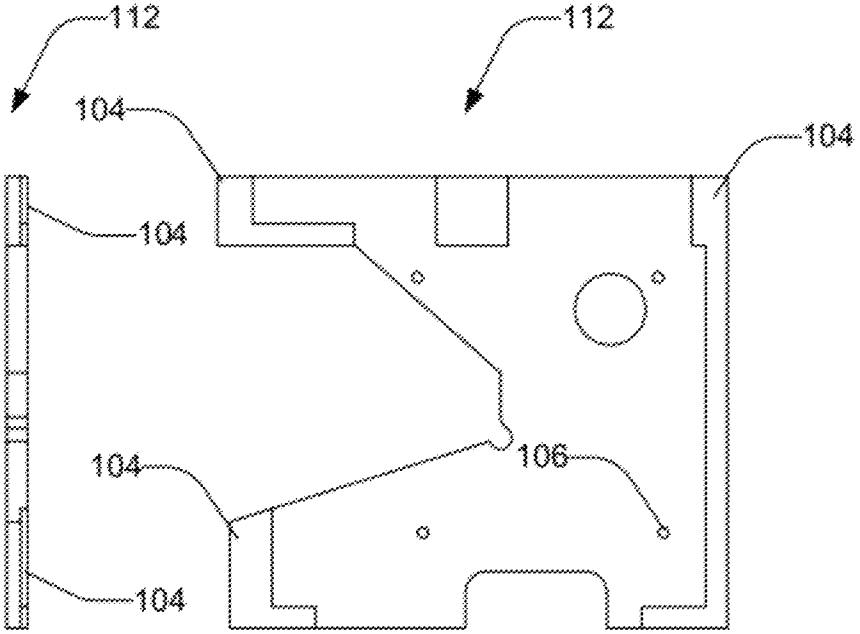
FIG. 44D
FIG. 44C
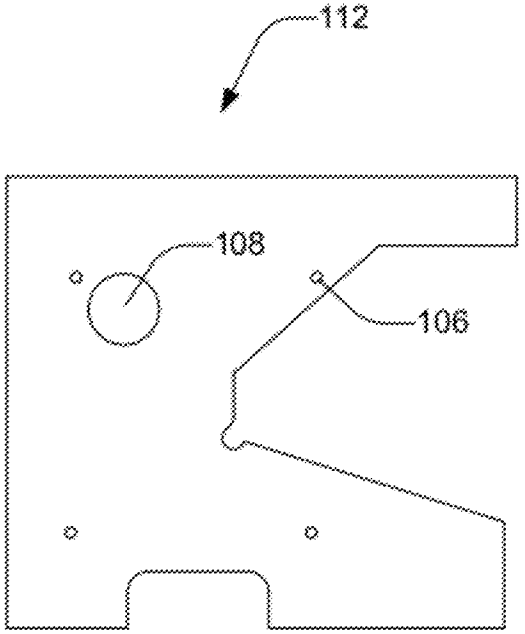
FIG. 44A

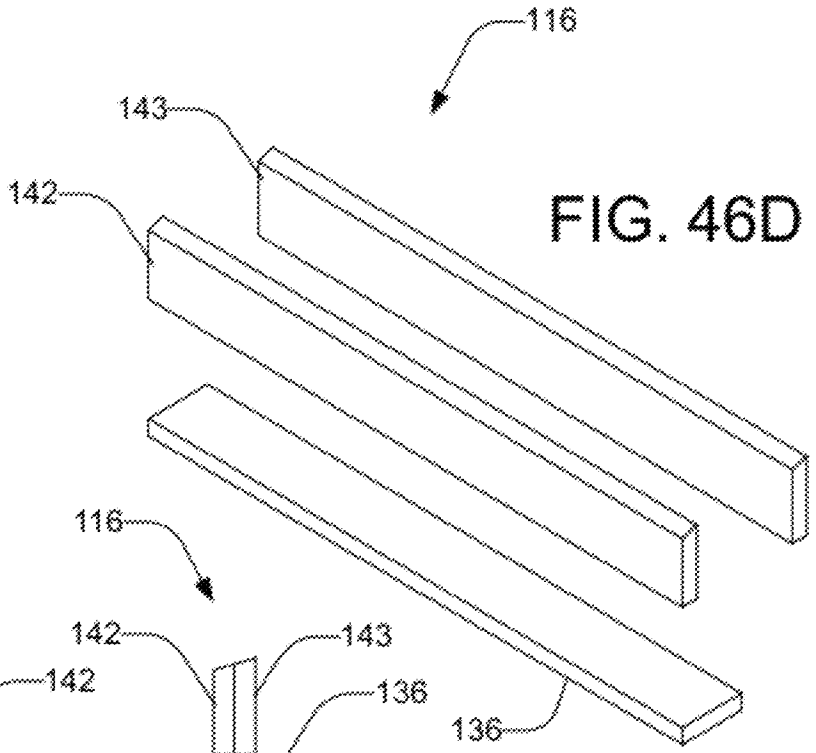
FIG. 46D
FIG. 46C
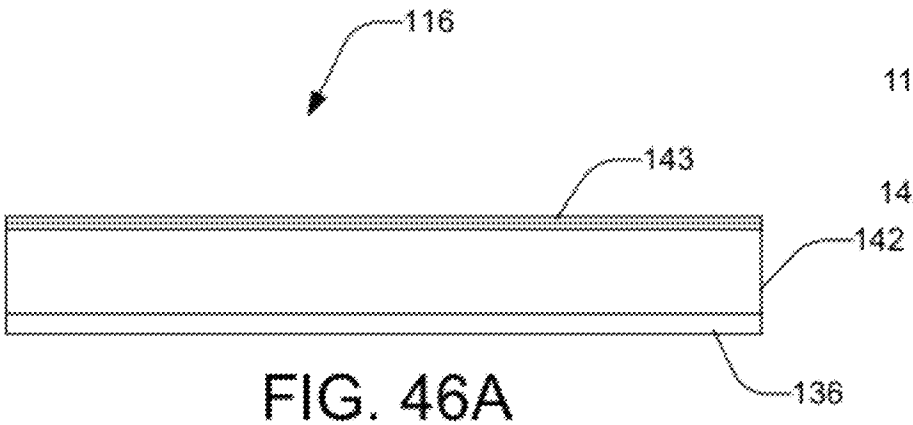
FIG. 46A

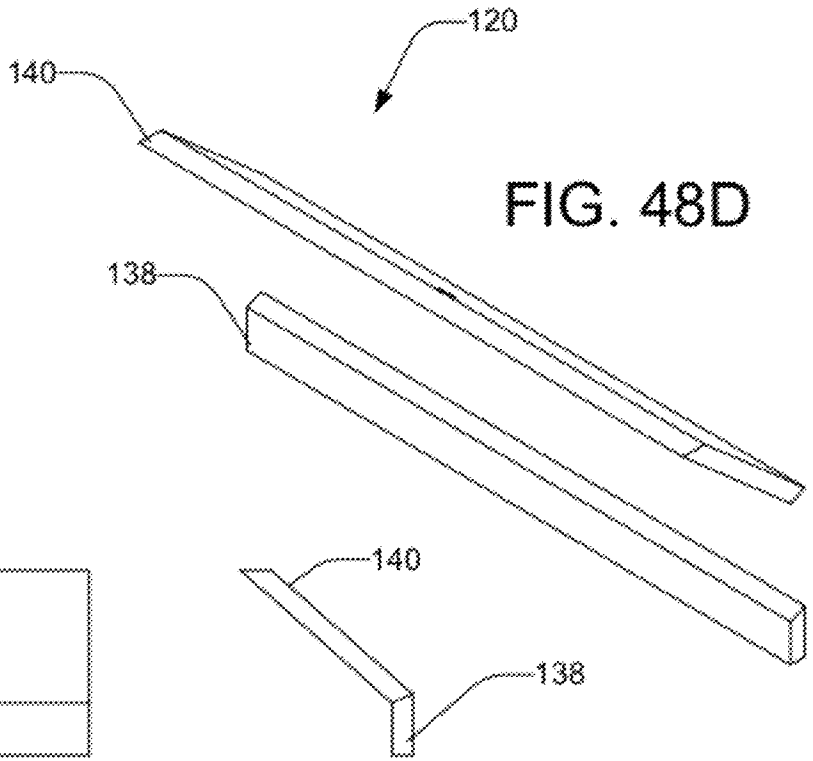
FIG. 48D
FIG. 48C
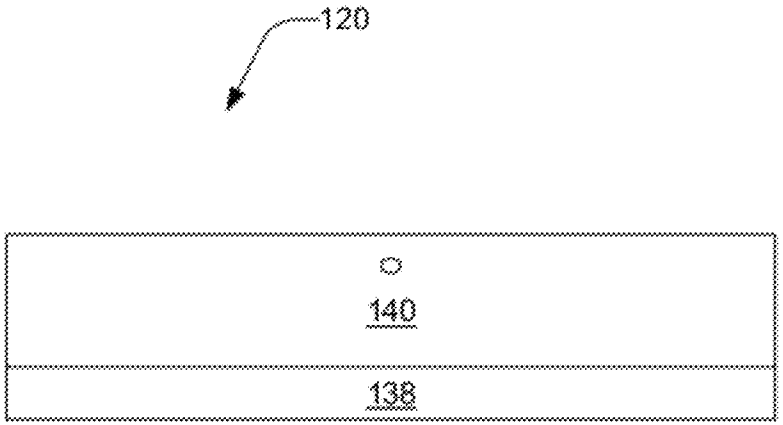
FIG. 48A

GAMING DEVICE BASE WITH SLIDABLE MOUNTING BRACKETS

CROSS-REFERENCE TO RELATED APPLICATIONS

This application claims priority to our co-pending provisional U.S. Patent Application Ser. No. 61/379,995, filed Sep. 3, 2010, the entirety of which is incorporated by reference herein. This application also claims priority to our co-pending provisional U.S. Patent Application Ser. No. 61/480,309, filed Apr. 28, 2011, the entirety of which is incorporated by reference herein.

BACKGROUND OF THE INVENTION

1. Field of the Invention

The present invention relates to bases for gaming devices or machines, such as slot machines, and in particular relates to gaming device bases that comprise a foundation to which a gaming device is attached, removably attached decor kits attached to the foundation, and adjustable attachment points.

2. The Prior Art

FIG. 1 is a perspective view showing a gaming system 20 comprising a gaming machine or device 22, such as a slot machine, located upon a gaming device base 24, in accordance with the prior art.

FIG. 2 is a perspective view showing an outlined shape of an exemplary gaming device 22, in accordance with the prior art. Though, in the gaming device 22, a player plays games by using game media such as coins, medals or tokens, or a card in which information of game value given to the player is stored, it will be described hereinafter the gaming device 22 in which medals are used. At the front surface of a cabinet 2 entirely forming the gaming device 22, a panel display unit 2A, a liquid crystal display unit 2B and a fixed display unit 2C, which have substantially vertical planes, are formed. In the cabinet 2 (at the rear side of the liquid crystal display unit 2B), three reels 3L, 3C, 3R (the first display means comprising the game result display means), on each outer periphery of which symbol line comprising a plural kinds of symbols is described, are rotatably arranged along a horizontal line. The reels 3L, 3C, 3R form the variable display means. Symbols on each reel (rotational drum type display device) can be seen through symbol display areas 21L, 21C, 21R (shown in FIG. 2 hereinafter). Each reel is constructed so as to be able to rotate at a constant rotational speed (for example, 80 rotations/minute).

At a lower position of the panel display unit 2A, the liquid crystal display unit 2B and the fixed display unit 2C, a frontward projection portion 4 having a substantially horizontal plane is formed. At the left side of the frontward projection portion 4, it is arranged a BET switch 5 for betting medals credited by button pressing operation. At the right side of the frontward projection portion 4, a medal insertion slot 6 is formed. At the front left side of the frontward projection portion 4, it is provided a C/P switch 7 for switching credit/payout of medals obtained in the game by the player based on button pressing operation. On the basis of switching by the c/p switch 7, medals are paid out from a medal payout opening 8 and the paid medals are accumulated in a medal receiving tray 9.

At the right side of the C/P switch 7, a start lever 10 (game start instruction means operable by the player), which starts rotation of the reels when operated by the player and starts variable display of the symbols (starts the game) within each of the symbol display areas 21L, 21C, 21R, is provided so as to be able to rotate within a predetermined angle. At the front center of the frontward projection portion 4 and the right side of the start lever 10, three stop buttons 11L 11C, 11R, which are operated to stop rotation of the reels 3L, 3C, 3R, respectively, are arranged. At the upper left and right sides of the cabinet 2, speakers 12L, 12R are arranged. Between the speakers 12L, 12R, a payout table panel 13 which shows winning combinations of the symbols and the number of medals paid out as awards, is provided.

BRIEF DESCRIPTION OF THE INVENTION

One or more gaming devices, such as slot machines, can be installed onto a gaming device base comprised of façade kits removably attached to a gaming device foundation. Entire façade kits may be swapped out, possibly along with corresponding gaming devices, or different elements of a façade kit may be replaced when they are damaged. When a gaming device base supports multiple gaming devices, the gaming devices may be arranged back-to-back, side-by-side, or both at the same time.

The tops of the gaming device bases either have replaceable top surfaces or adjustable attachment points in order to allow different gaming devices to be attached to any given base. In one embodiment of the later, adjustable mounting brackets are utilized that provide elongated bolt hole slots through which bolts can be inserted from a gaming device. The gaming devices are then secured to a base by use of nuts inserted and tightened over the bolts. The adjustable mounting brackets can be slid right or left when bolts through them have not been secured with nuts. The mounting brackets can also be easily inserted and removed. The result is that the mounting points for gaming devices can be adjusted in two dimensions, allowing for the installation of most gaming devices, regardless of bolt and cable configurations.

BRIEF DESCRIPTION OF THE DRAWINGS

Many of the FIGs. below are identified as showing "standard views" of an object. In such FIGs., typically four sub-FIGs. are shown, with the first three (A-C) corresponding to the front (A), top (B), and right side (C) third-angle orthographic multiview projections of the object. In some cases, either a top (B) or right side (C) view is not provided in situations where that view would not add to the understanding of the invention. A fourth, perspective, view (D) may then shown above the right side (C) and to the right of the top (B) view of the object. This is done to simplify the description of the FIGs.

FIGS. 4 through 6 are perspective views of gaming device bases supporting multiple gaming devices, in accordance with different embodiments of the present invention;

FIG. 7 is an exploded perspective view of an exemplary façade kit 30 and foundation 40, in accordance with one embodiment of the present invention; and FIG. 8 is a perspective view of a gaming device base 50 constructed utilizing the façade kit 30 and foundation 40 shown in FIG. 7;

FIGS. 44A, 44C, and 44D are standard views of the left side panel for the gaming device base shown in FIG. 42;

FIGS. 46A, 46C, and 46D are standard views of the toe kick sub-assembly for the gaming device base shown in FIG. 42;

FIGS. 48A, 48C, and 48D are standard views of the door sub-assembly for the gaming device base shown in FIG. 42;

DETAILED DESCRIPTION

Figure 1:
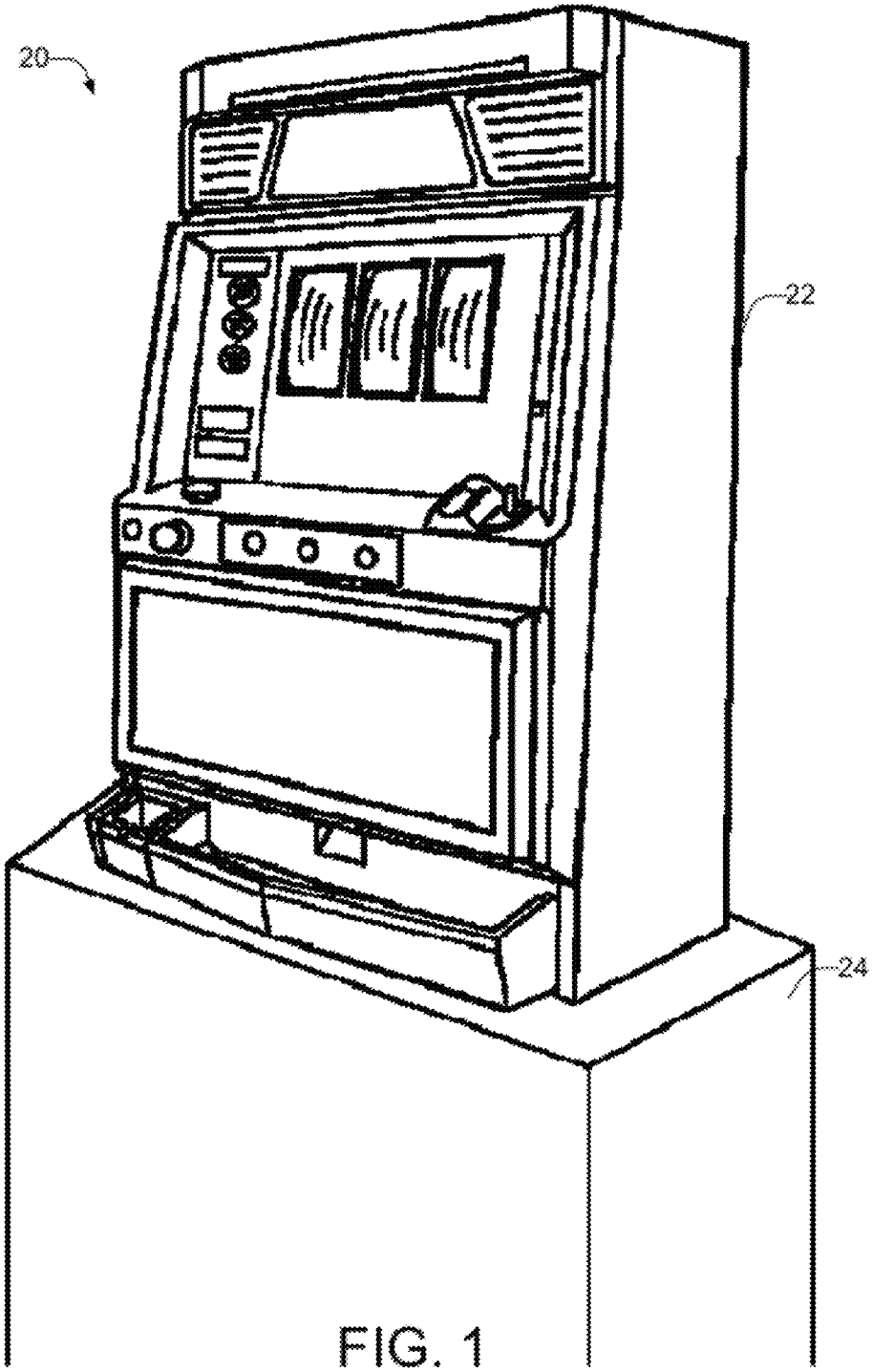
FIG. 1 (PRIOR ART)
FIG. 1 is a perspective view showing a gaming system comprising a gaming device, such as a slot machine, located upon a gaming device base, in accordance with the prior art.
Figure 2:
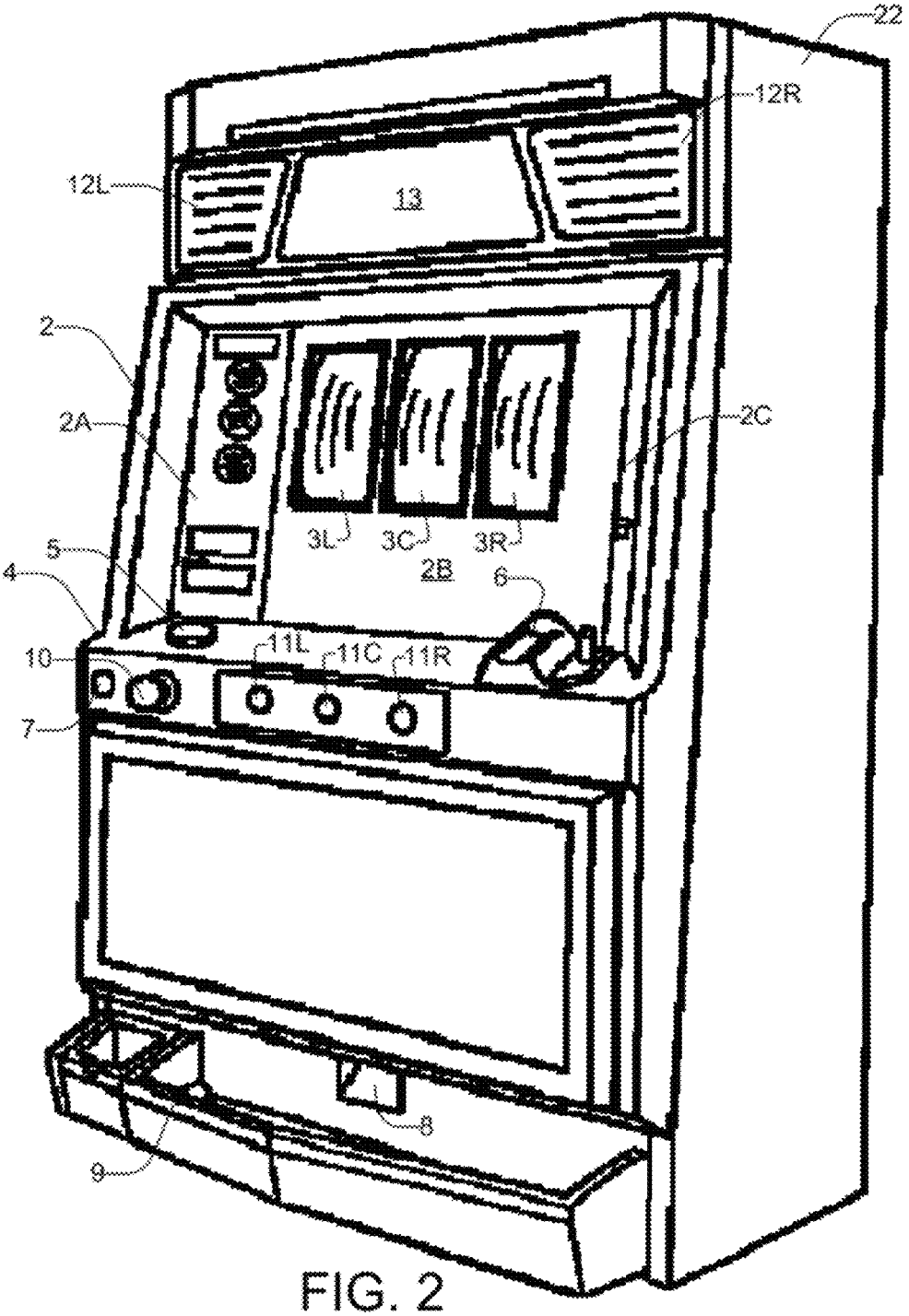
FIG. 2 (PRIOR ART)
FIG. 2 is a perspective view showing an outlined shape of an exemplary gaming device 22, in accordance with the prior art.

The following description of various embodiments of the invention is not intended to limit the scope of the invention to these embodiments, but rather to enable any person skilled in the art of constructing gaming device bases to make and use the invention.

Gaming device bases 24 have generally consisted of specific types (footrest, bottom, bottomless) with different facades (flat, curved, geometric shapes, color); specific to that individual product. What has currently lacked in this industry is a product that easily and readily combines the ability to change the look (façade) of a gaming device base and/or the type. The present invention discloses a system that uses what is called a gaming device base "foundation", which will allow "façade kits" to easily attach to the "foundation" without moving or replacing the "foundation".

The gaming device base "foundation" typically consists of a frame structure that contains mounting locations for the "façade kits". The "foundation" will typically stay in a fixed position during the attachment or detachment process of the "façade kits". The end user will typically have the ability to keep the "foundation" on site during decor changes, eliminating the need to re-finish the complete gaming device base.

The "façade kits" will typically consist of individual components grouped together to display the look of a type of gaming device base. Once attached to the "foundation", the "façcade kits" will display the desired decor, typically hiding the "foundation". Each component in the "façade kit" is typically readily available for replacement independently of the complete "façade kit"; allowing damaged/non-conformant components to get replaced and/or mix and match color/finish opportunities. The components of a "façcade kit" may be constructed of metal, wood, composite materials, other materials, or a combination thereof.

The tops of the gaming device bases either have replaceable tops or adjustable attachment points in order to allow different gaming devices to be attached to any given base. The replaceable tops operate similarly to the replaceable facades, with different tops being installed for different gaming devices to match the bolt and cable configuration of each different machine. The tops may be constructed of metal, wood, composite materials, other materials, or a combination thereof.

In one embodiment implementing adjustable attachment points, adjustable mounting brackets are utilized that provide elongated bolt hole slots through which bolts can be inserted from a gaming device. The gaming devices can then secured by use of nuts inserted and tightened over the bolts. The adjustable mounting brackets can be slid right or left when bolts through them have not been secured with nuts. The elongated slots in the mounting brackets allow forward and backwards adjustment of mounting points. Mounting brackets can be easily inserted and removed. The result is that the mounting points for gaming devices can be adjusted in two dimensions, allowing for the installation of most gaming devices, regardless of bolt and cable configurations.

Figure 3:
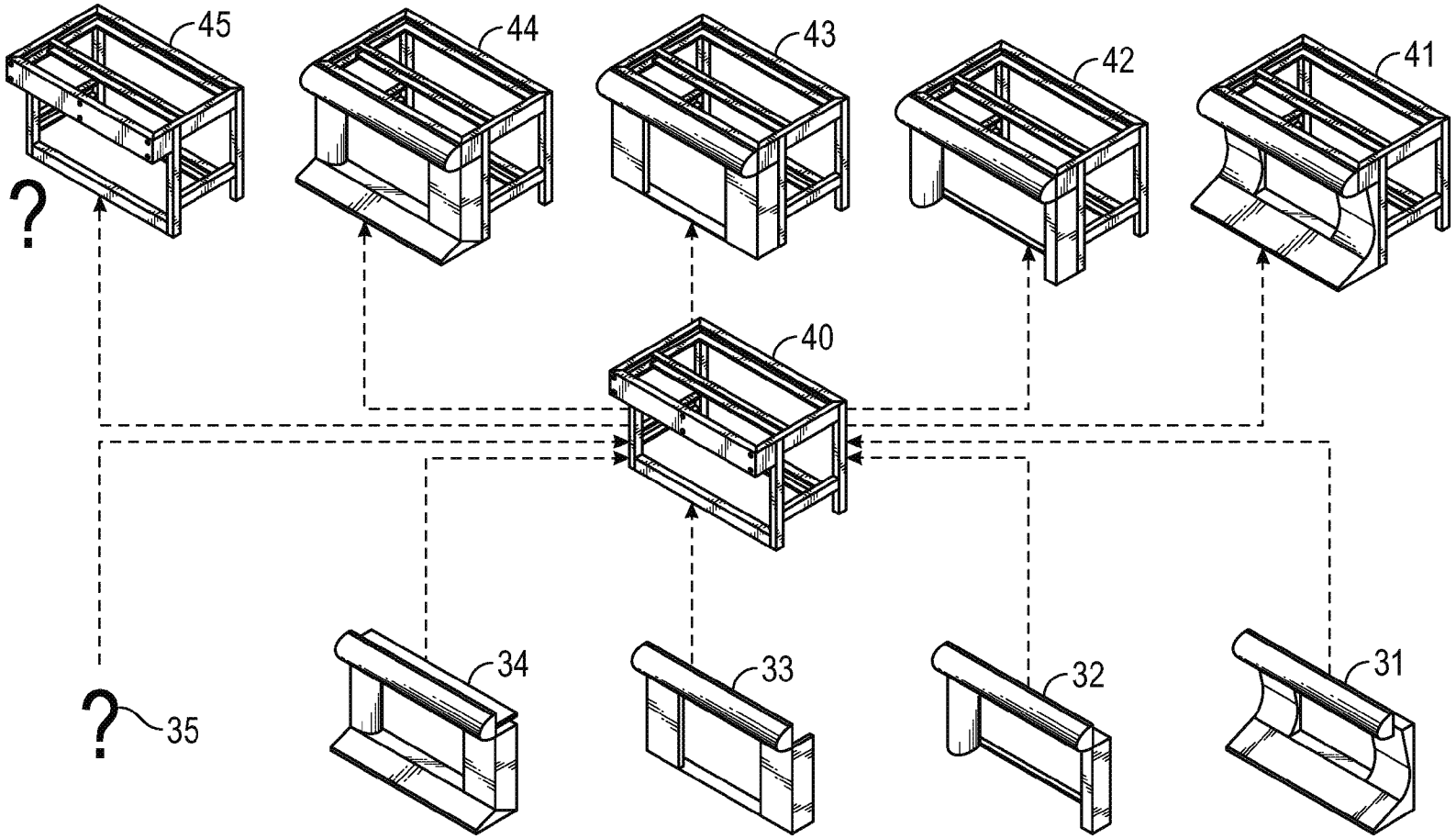
FIG. 3 is a diagram showing the attachment of various façade kits to a foundation, resulting in custom gaming device bases, in accordance with one embodiment of the present invention.
Figure 9:
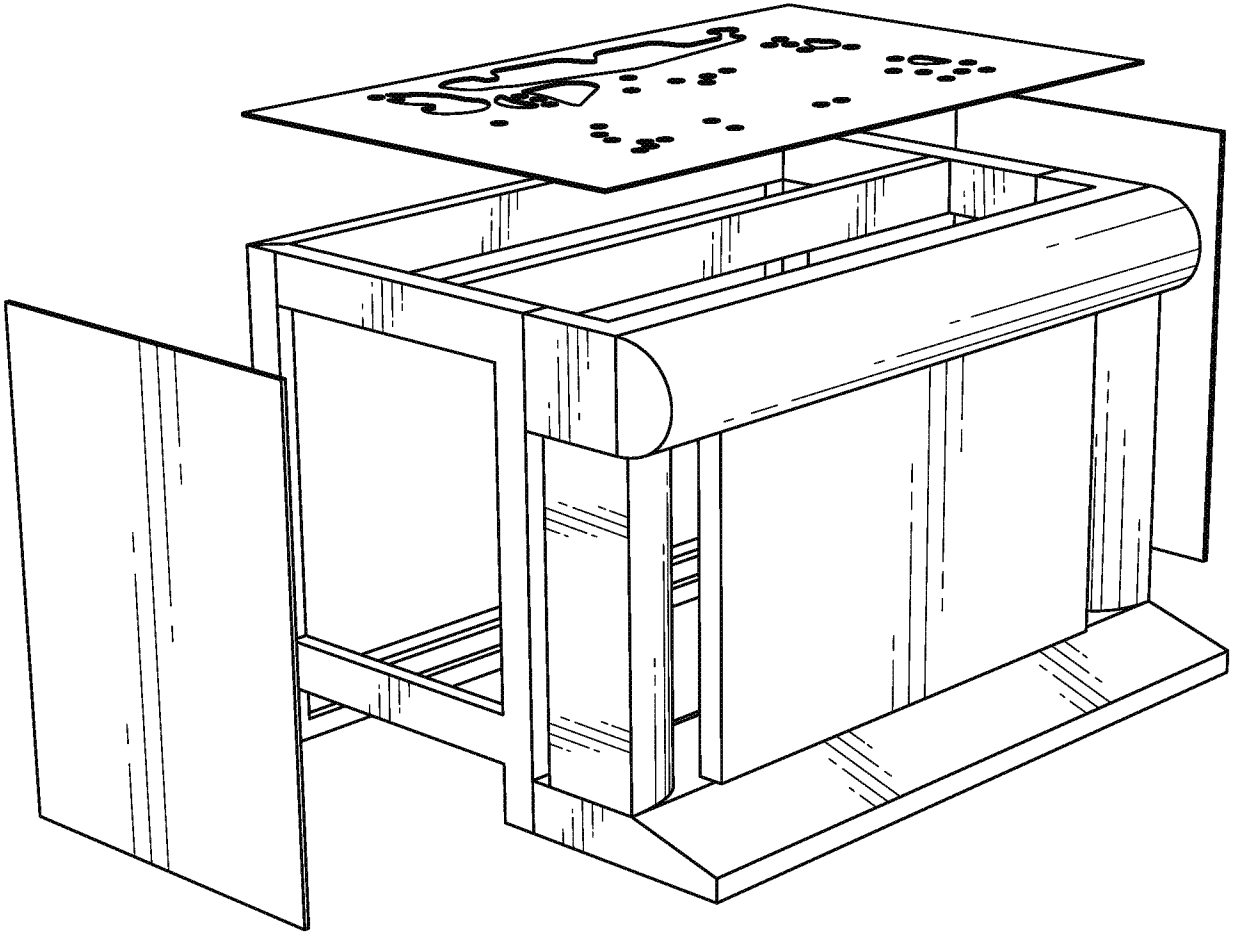
FIG. 9 is a perspective view of an exploded gaming device base utilizing replaceable top panels to accommodate different gaming devices.
Figure 10:
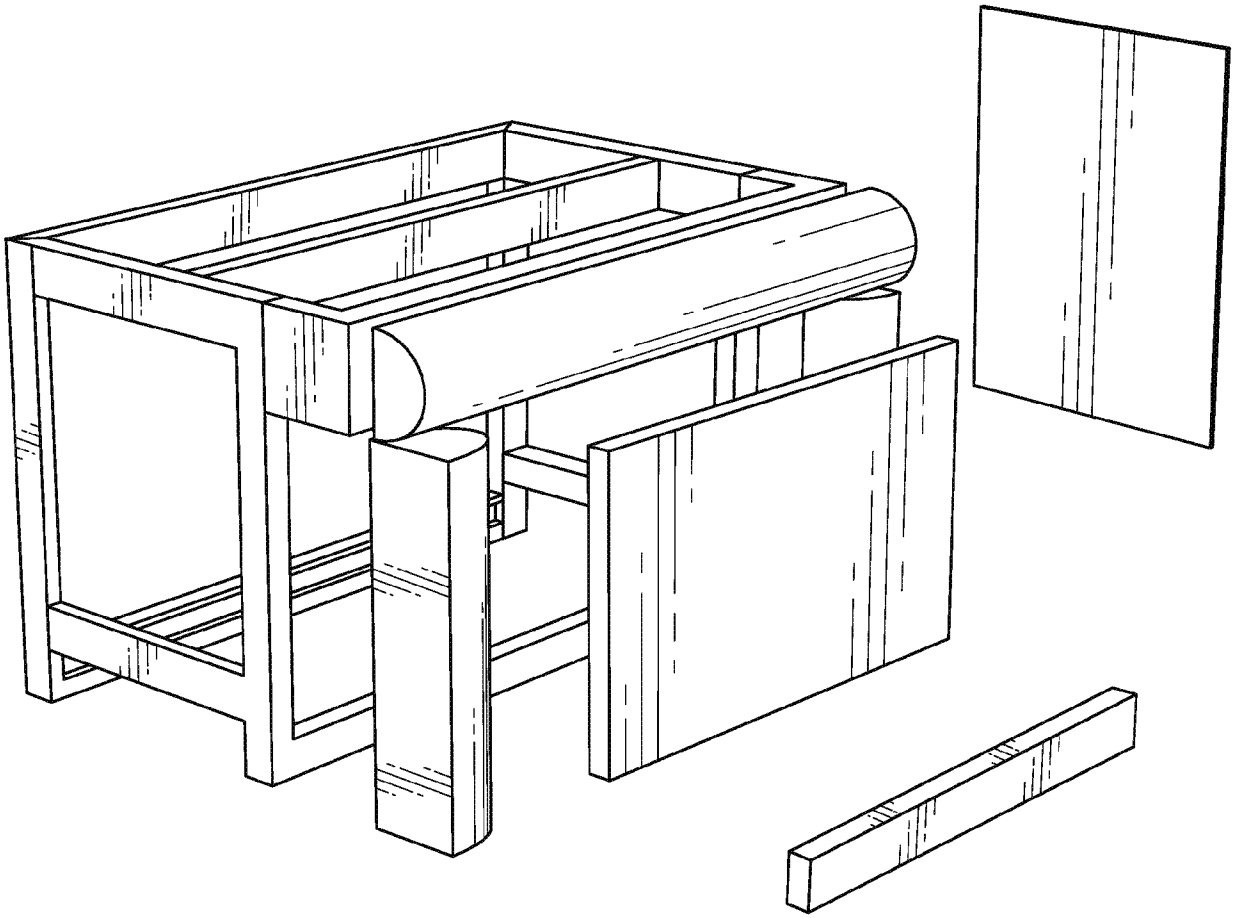
FIG. 10 is a perspective view of a gaming device base foundation with replaceable top panel and front façade.
Figure 11:
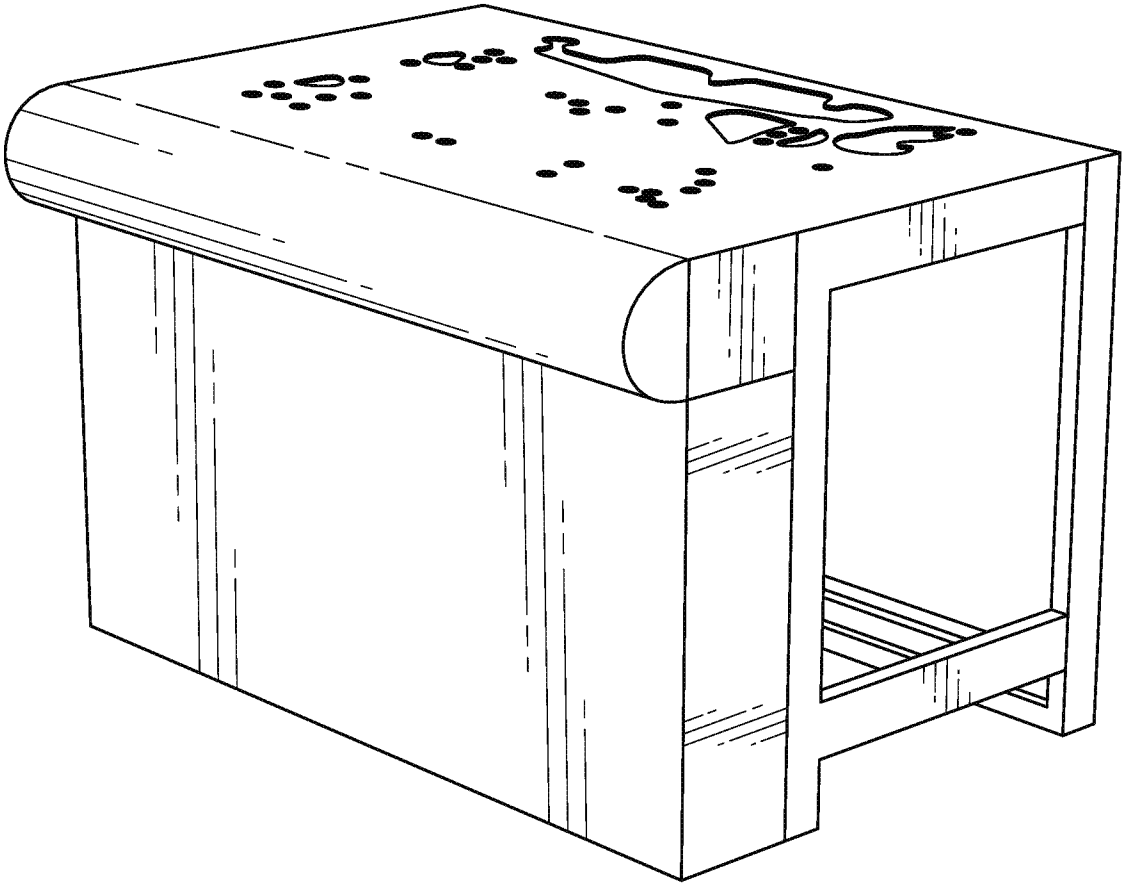
FIG. 11 is a perspective view of the gaming device base foundation shown in FIG. 12 with a top panel and front façade attached.
Figure 12:
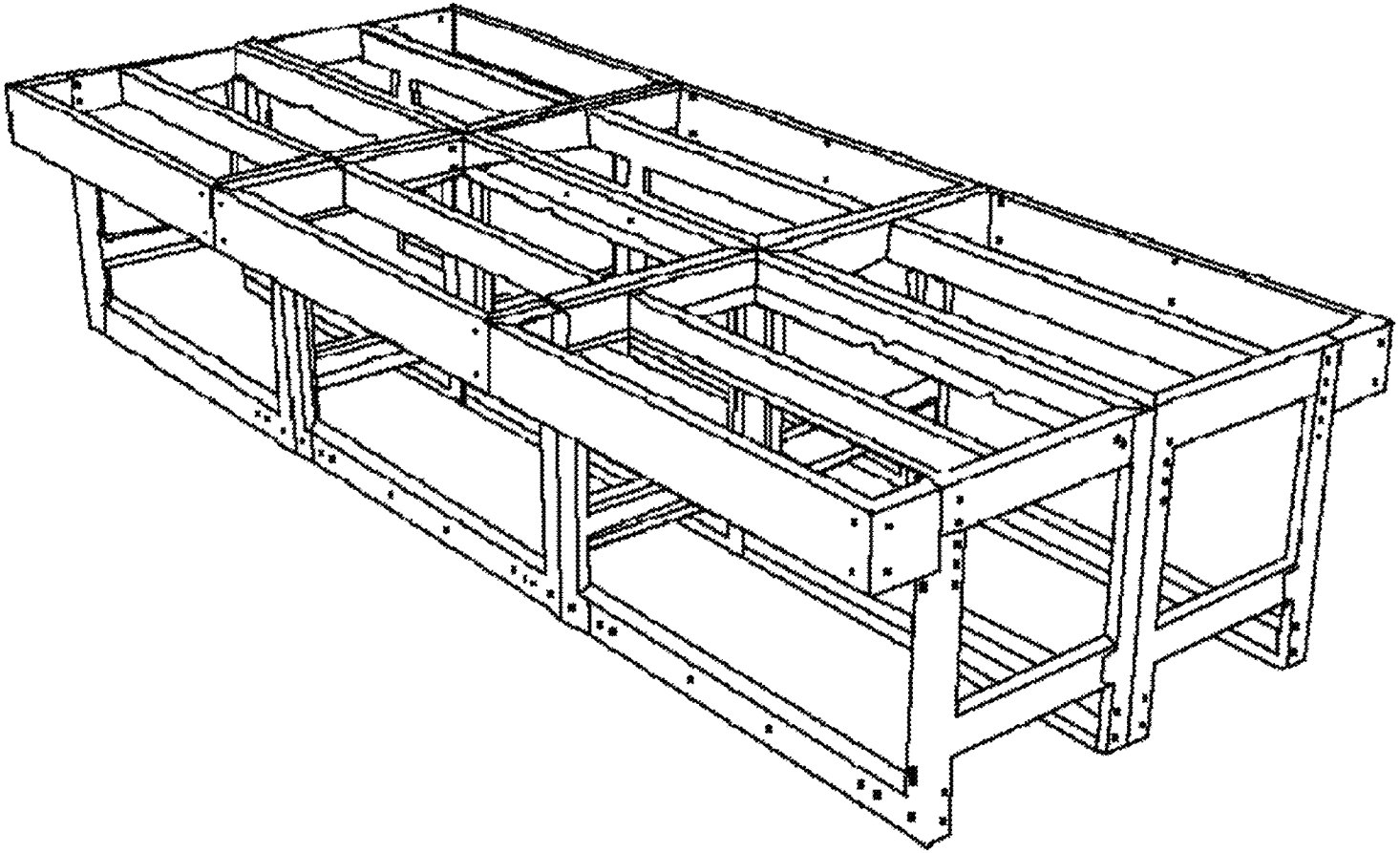
FIG. 12 is a perspective view of a bank of six gaming device base foundations without any facades or top panels attached.
Figure 13:
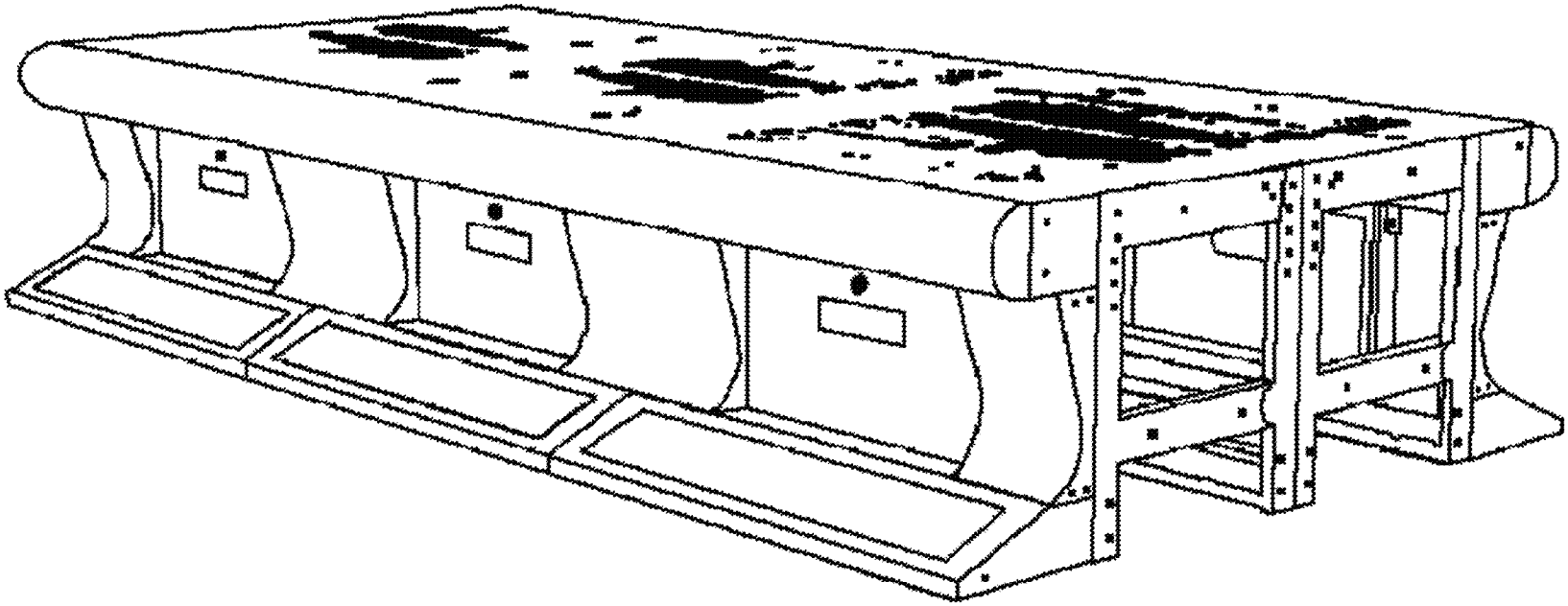
FIG. 13 is a perspective view of the bank of gaming device bases shown in FIG. 12 with front facades and top panels installed.
Figure 14:
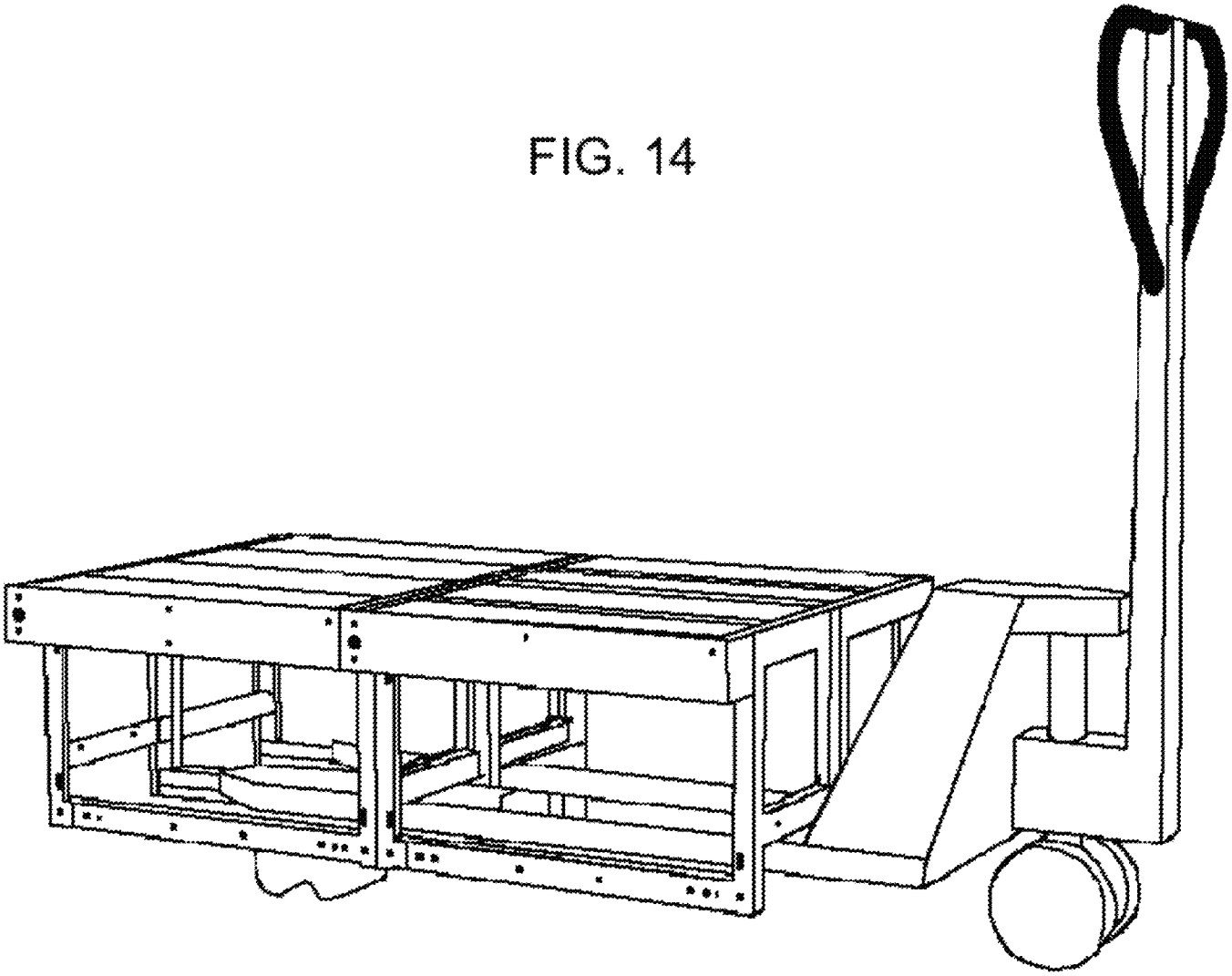
FIG. 14 is a perspective view of a handcart moving a bank of four gaming device base foundations.
Figure 15:
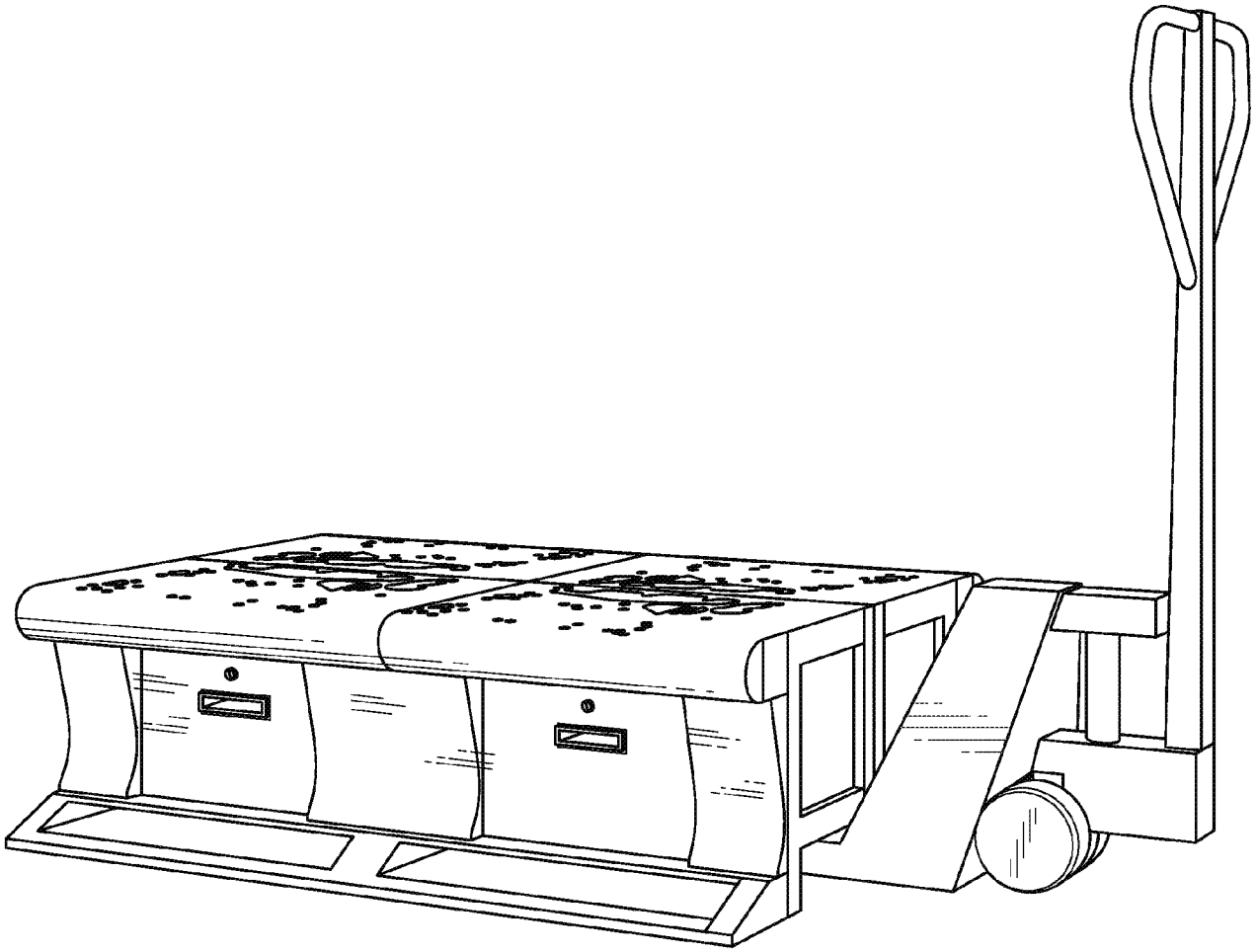
FIG. 15 is a perspective view of the handcart and bank of gaming device bases shown in FIG. 14 with the facades and top panels installed.

FIG. 3 is a diagram showing the attachment of various façade kits to a foundation, resulting in custom gaming device bases, in accordance with one embodiment of the present invention. In this FIG., four different gaming device base façade kits 31, 32, 33, 34 are shown, with a fifth, exemplary, façade kits 35 shown as a "?", indicating that users may select different façade kits. The façade kits 31-35 are attached to the front, and alternatively, sides and/or back, of a gaming device base foundation 40, resulting in corresponding custom gaming device bases 41, 42, 43, 44, and 45 (with the later showing the "?" for façade kit 35 to indicate a user selectable façade kit).

Façade kits 31-35 are preferably removably fixed to the foundations 40. This may be done with fastening means such as screws, nuts and bolts, anchors, banding, captive fasteners, captive screws, cotter pins and wire clips, dowel pins, hitch pins and linch pins, hook and loop fasteners, industrial pins, locating and fixturing pins, lockbolts, nails, nuts, precision locknuts, quick connect fasteners, retaining rings and snap rings, rivets, screws, shoulder screws, snap fasteners, specialty fasteners, specialty pins, staples, studs, threaded assemblies, threaded inserts, threaded rods, magnets, and other mechanisms within the known arts and later discovered. There typically is a tradeoff between ease of removal and replacement, and durability, and in the typical casino environment, it is expected that more sturdy attachment mechanisms, such as the use of screws or nuts and bolts will preferably be utilized. Façade kits 31-35 may match specific games, or may be more generic or may be selected by other criteria. Façade kits 31-35 may be replaced without the necessity of replacing the gaming devices 22 located upon and/or attached to the gaming device bases 24, and gaming devices 22 may be replaced without the necessity of replacing the underlying gaming device bases 24, and, in particular, in the preferred embodiment, gaming devices 22 and façade kits 31-35 may be replaced without the necessity of replacing the underlying gaming device base foundations 40.

FIGS. 4 through 6 are perspective views of gaming device bases 24 supporting multiple gaming devices 22, in accordance with different embodiments of the present invention. FIG. 4 is a perspective view of a back-to-back gaming device base 52, wherein gaming devices 22 are located back-to-back on the gaming device base 52. FIG. 5 is a perspective view of a side-by-side gaming device base 54, wherein gaming devices 22 are located side-by-side on the gaming device base 54. This FIG. shows a gaming device base 54 for two gaming devices 22. However, other numbers of gaming devices 22 located side-by-side are also within the scope of the present invention. FIG. 6 is a perspective view of a quad gaming device base 56, wherein four gaming devices 22 can be located, two pair side-by-side and back-to-back on the gaming device base 56. However, other numbers of gaming devices 22 located side-by-side are also within the scope of the present invention. In a preferred embodiment utilizing multiple gaming device bases 52, 54, 56, all the gaming devices 22 for any given base are of the same type, and the façade kits 31-35 corresponding to each gaming device 22 are the same (with the proviso that there may special considerations for right, left, and middle façade kits). However, in other embodiments of the present invention, different façade kits 31-35 may be utilized with a single multiple gaming device base 52-56.

FIG. 7 is an exploded perspective view of an exemplary façade kit 30 and foundation 40, in accordance with one embodiment of the present invention. FIG. 8 is a perspective view of a gaming device base 50 constructed utilizing the façade kit 30 and foundation 40 shown in FIG. 7.

FIGS. 16-40 illustrate one embodiment of the present invention where adjustable mounting points are provided that allow quick and easy installation of different gaming devices onto a gaming device base. Instead of the typical top for a gaming device base, with holes specifically designed to match the mounting bolts and holes of a specific gaming device, the area under the gaming device is primarily or completely open. The area on the top of the base around the gaming device is covered by replaceable top skins of different sizes. Underneath the gaming device on the top of the gaming device base are adjustable mounting brackets that can slide right or left when a gaming device is not secured to the base unit. The brackets have long slots through which bolts for securing gaming devices to the bases are inserted. The long slots allow the bolts to be positioned forwards or backwards. The combination of the sliding mounting brackets and the long slots in the brackets provide almost complete adjustability of the mounting points for gaming devices in two dimension. Typically there will be one mounting bracket for each bolt utilized to secure a gaming device to a base. The mounting brackets can be easily added or removed, as needed. They are designed to slide easily when a gaming device is not attached, but not to move when a gaming device is attached to a mounting bracket.

Figure 16:
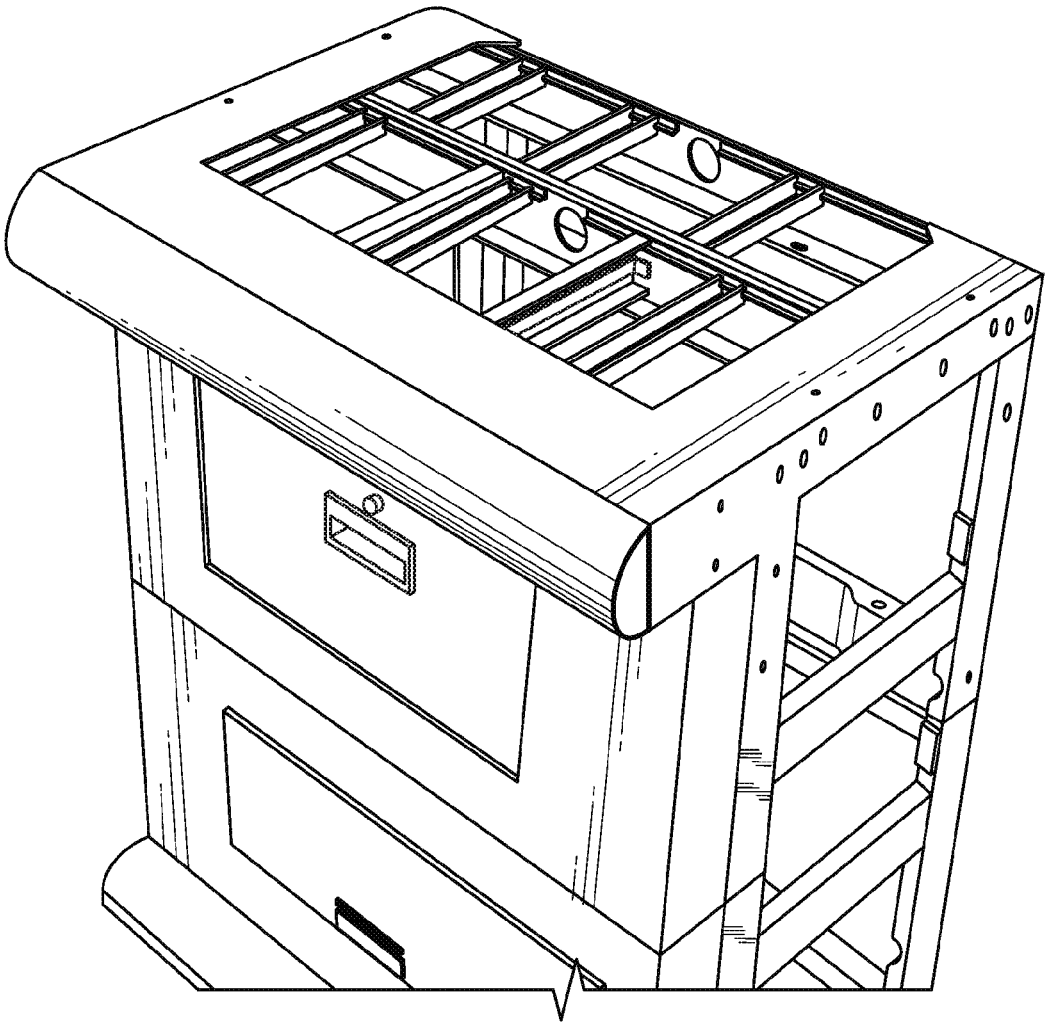
FIG. 16 is a perspective view of an assembled gaming device base with adjustable mounting points, in accordance with one embodiment of the present invention.

FIG. 16 is a perspective view of an assembled gaming device base with adjustable mounting points, in accordance with one embodiment of the present invention. A front façade and top skin are attached. This FIG. shows six mounting brackets installed in different positions.

Figure 17:
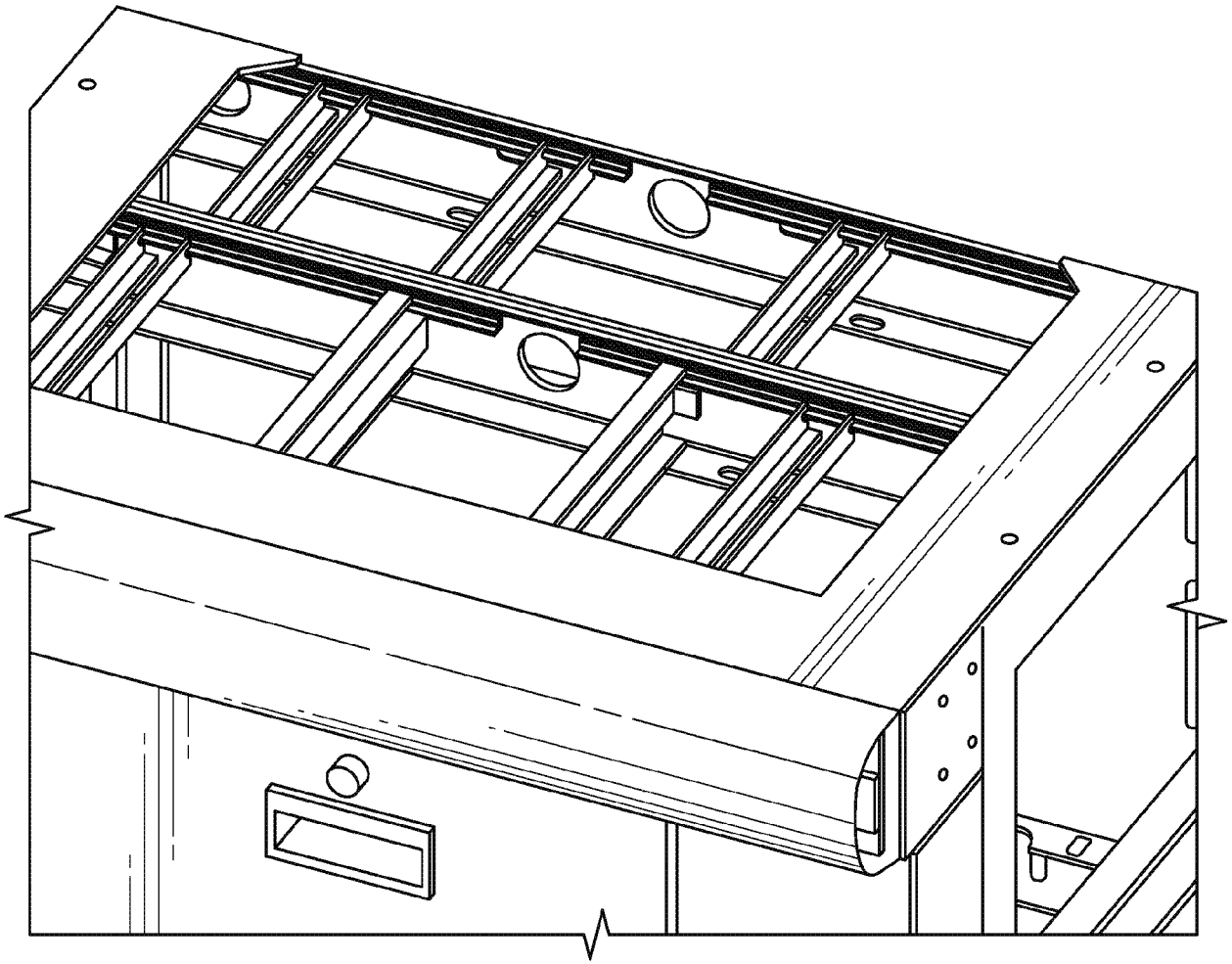
FIG. 17 is a top perspective view of an assembled gaming device base with adjustable mounting points, in accordance with one embodiment of the present invention.

FIG. 17 is a top perspective view of an assembled gaming device base with adjustable mounting points, in accordance with one embodiment of the present invention. Five mounting brackets are shown, two longer mounting brackets in the front and three shorter mounting brackets in the rear of the top of the gaming device base. This FIG. shows how the mounting brackets attach to cross braces.

Figure 18:
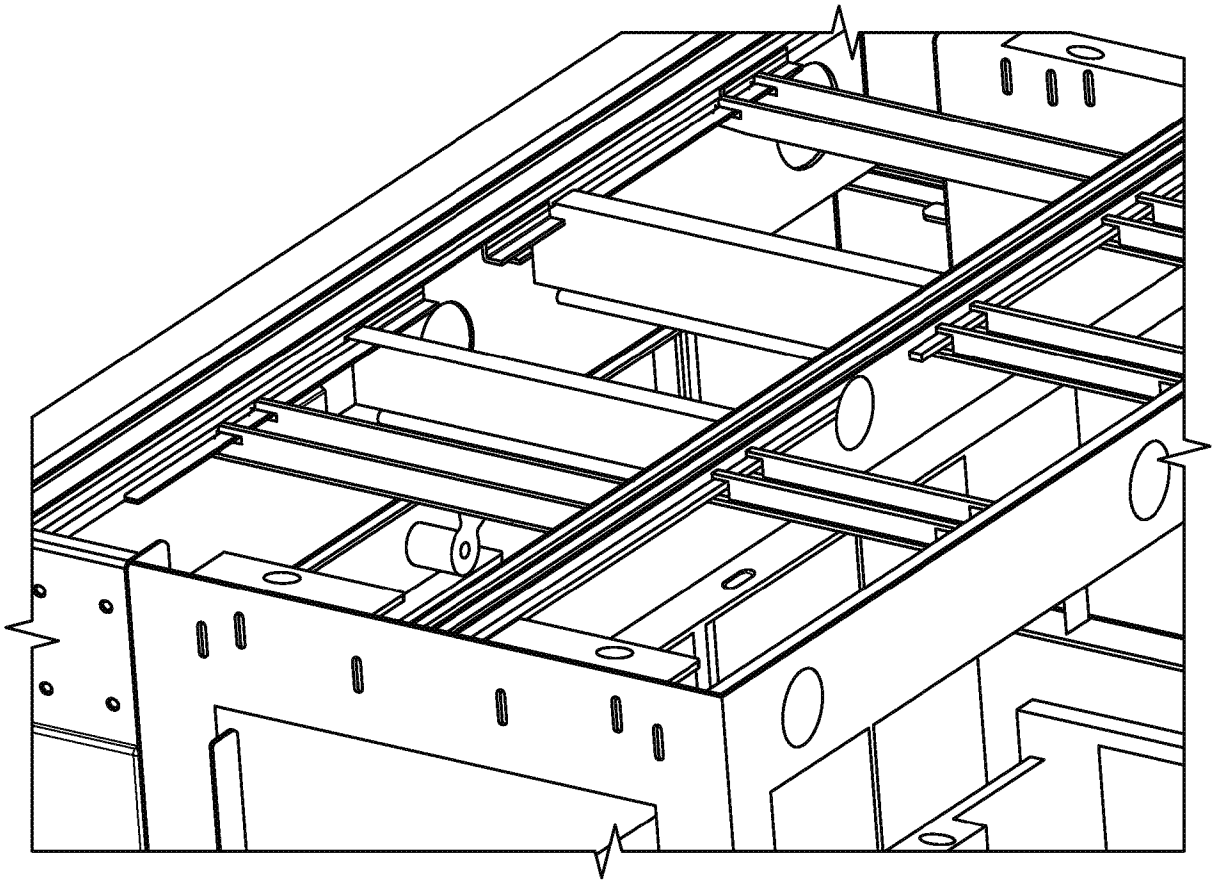
FIG. 18 is a top perspective view of a gaming device base with adjustable mounting points showing installation of mounting brackets, in accordance with one embodiment of the present invention.

FIG. 18 is a top perspective view of a gaming device base with adjustable mounting points showing installation of mounting brackets, in accordance with one embodiment of the present invention. This FIG. shows how the mounting brackets attach to cross braces and move along channels in the slot base frame. Also shown are gaps in the channels that allow easy addition or removal of mounting brackets.

Figure 20:
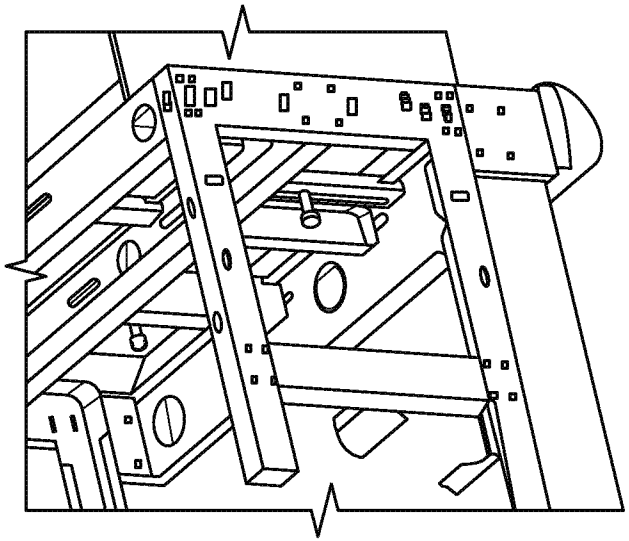
FIG. 20 is a bottom perspective view of a gaming device base without facades or top skin attached that shows attachment of a gaming device with bolts inserted through adjustable mounting brackets, in accordance with one embodiment of the present invention.
Figure 19:
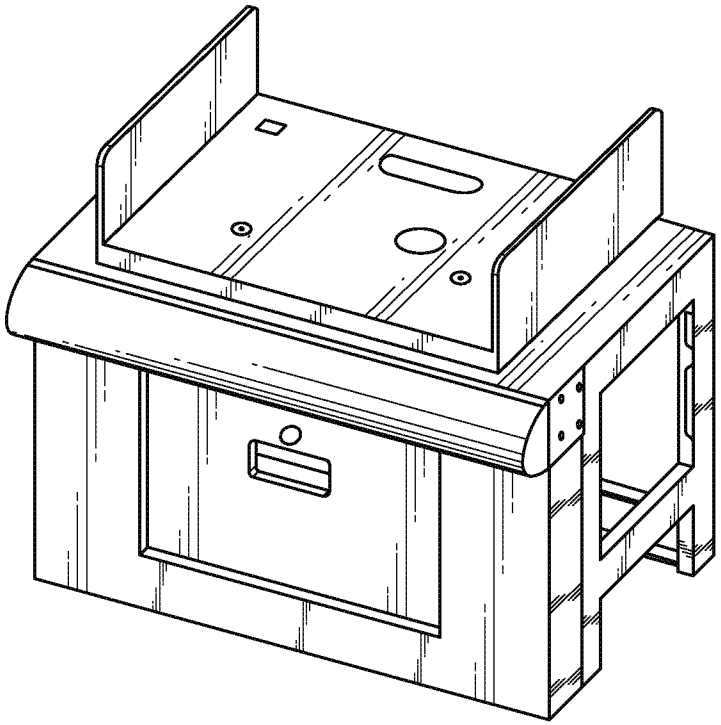
FIG. 19 is a perspective view of a gaming device base with a gaming device installed.
Figure 21D:
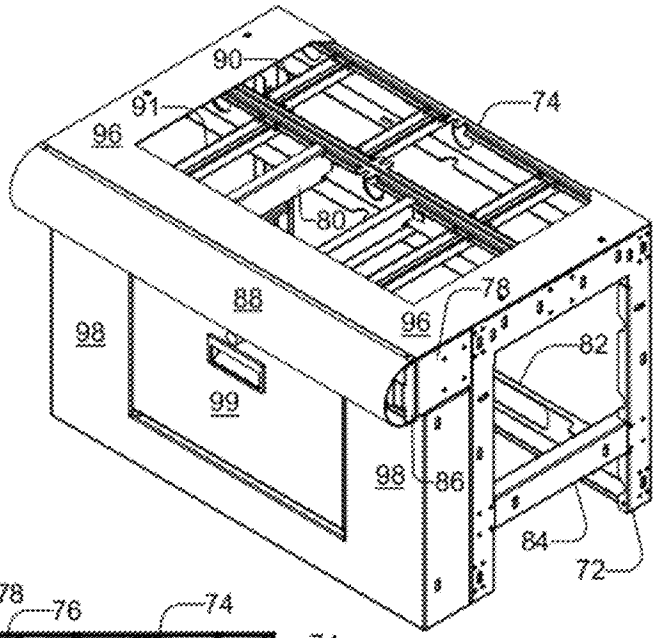
FIGS. 21A-21D are standard views of an exemplary gaming device base with front façade and top skin attached that provides adjustable attachment points, in accordance with one embodiment of the present invention.
Figure 21C:
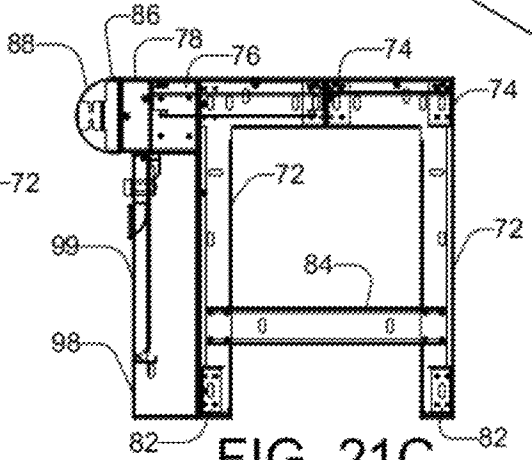
Figure 21B:
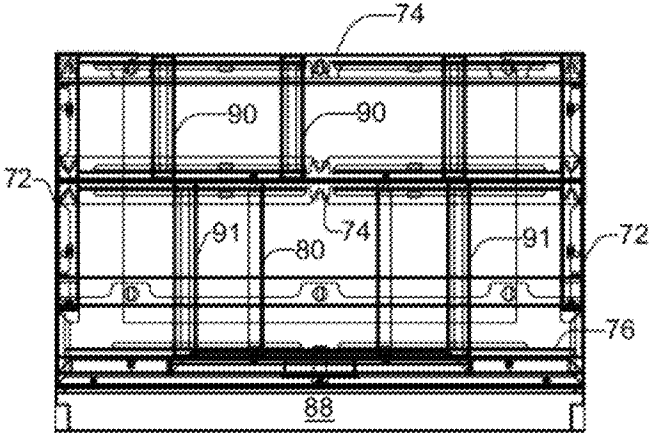
Figure 21A:
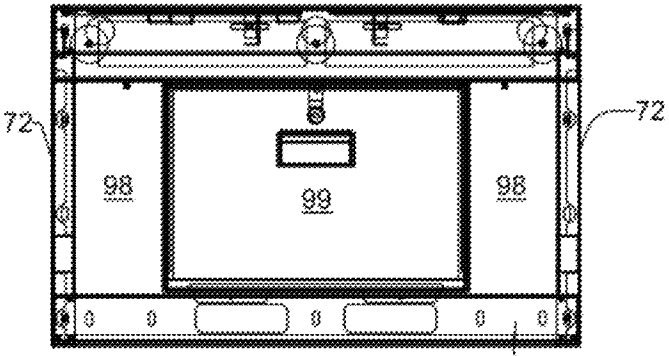

FIG. 19 is a perspective view of a gaming device base with a gaming device installed. FIG. 20 is a bottom perspective view of a gaming device base without facades or top skin attached that shows attachment of a gaming device with bolts inserted through slots in the adjustable mounting brackets, in accordance with one embodiment of the present invention. The bolts to secure a gaming device to a base unit are shown inserted through the long slots in the mounting brackets with nuts attached to the ends of the bolts, but not tightened.

FIGS. 21A-21D are standard views of an exemplary gaming device base with front façade and top skin attached that provides adjustable attachment points, in accordance with one embodiment of the present invention.

Figure 22:
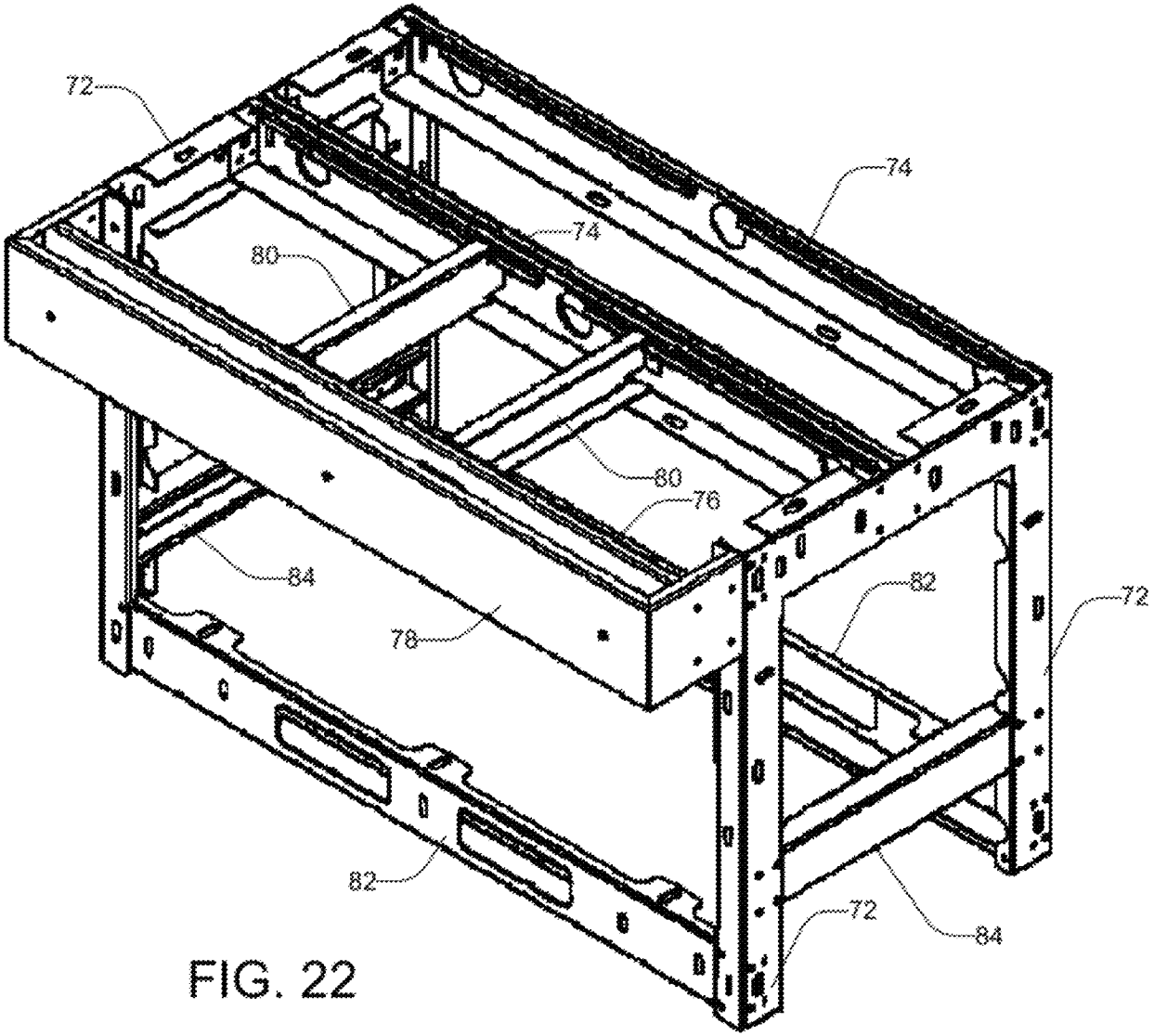
FIG. 22 is a perspective view of an assembled gaming device base without front façade or top skin attached that provides adjustable attachment points, in accordance with one embodiment of the present invention.
Figure 23B:
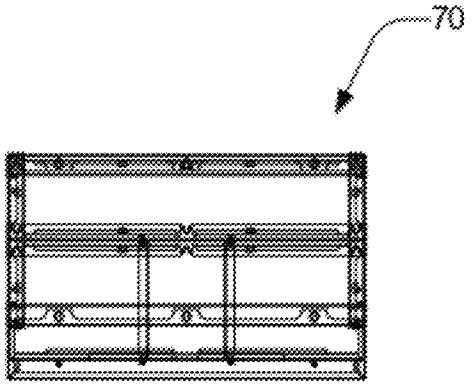
FIGS. 23A-23D are standard views of the gaming device base shown in FIG. 22 without front façade, top skin, or bull nose section attached.
Figure 23A:
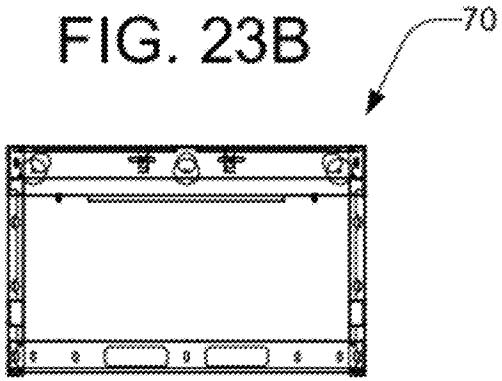
Figure 23C:
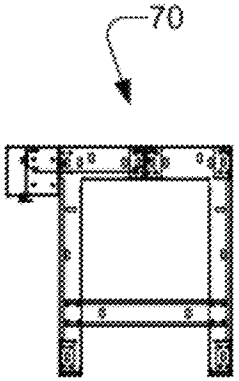
Figure 23D:
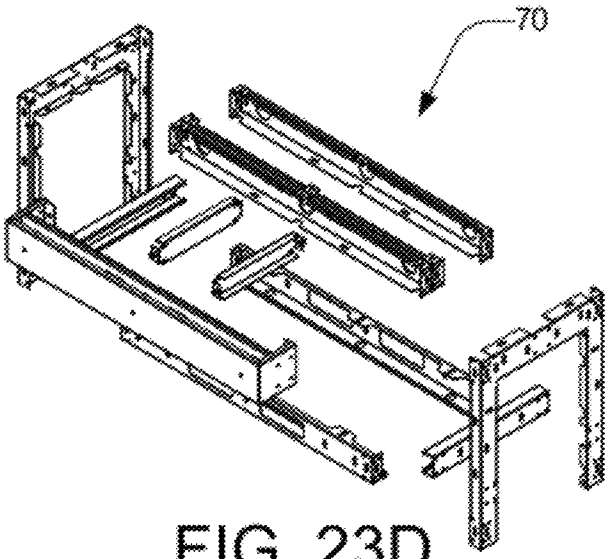

FIG. 22 is a perspective view of an assembled gaming device base without front façade or top skin attached that provides adjustable attachment points, in accordance with one embodiment of the present invention. An gaming device base frame is shown. The frame has left and right side structures 72. At the top of the frame, rear and center cross braces 74 are attached to the side structures 72, as well as a front channel 76. A single rear cross brace 74 is installed with a mounting bracket channel 75 positioned to the inside of the frame. A pair of cross braces 74 are installed together near the center of the frame, with their mounting bracket channels 75 facing outwards. Mounting brackets 90/91 (see FIG. 34) can be inserted and removed from the mounting bracket channels 75 on the cross braces 74 and front channel 76. Attached to the front of the front channel 76 is a bull nose mount 78. Installed between the center cross braces 74 and front channel 76 are center supports 80. On the bottom of the frame, horizontal cross members 82 are installed between the two side structures 72. Horizontal stiffeners 84 are installed between the legs of the two side structures 72 to provide additional support. While this embodiment illustrates a metal gaming base, other materials are also within the scope of the present invention. For example, game bases may be constructed from metal, wood, composite materials, other materials, or combinations thereof.

Figure 24:
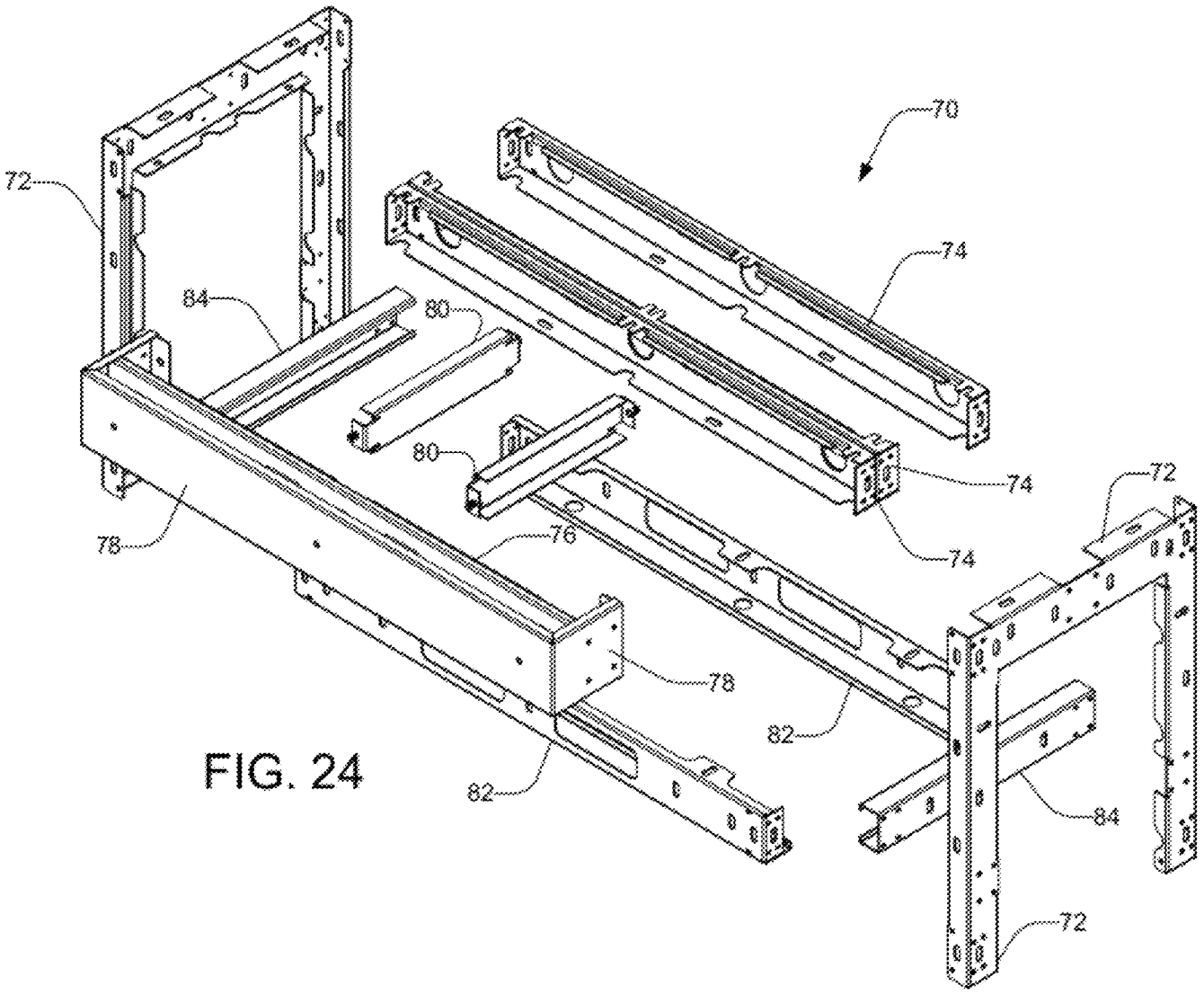
FIG. 24 is a perspective exploded view of the gaming device base shown in FIGS. 23A-23D.
Figure 25D:
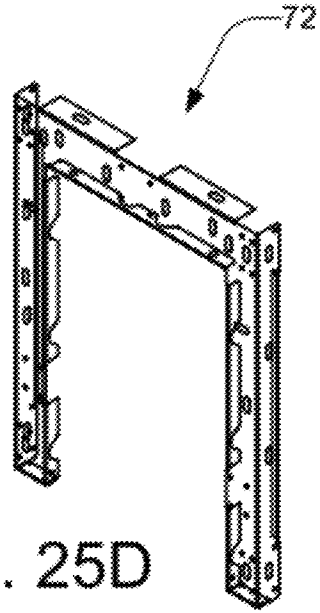
FIGS. 25A-25D are standard views of a side structure for the gaming device base shown in FIG. 24.
Figure 25B:
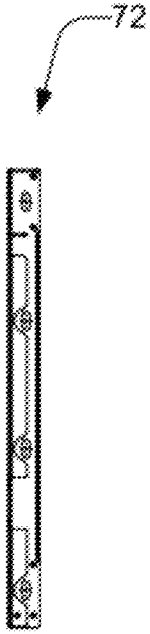
Figure 25C:
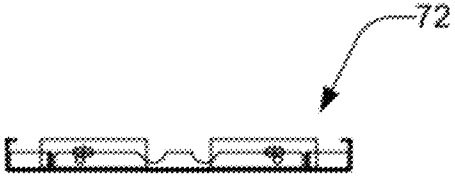
Figure 25A:
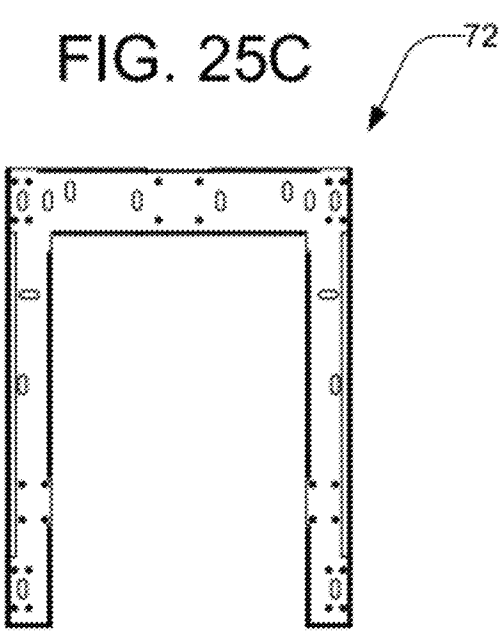

FIGS. 23A-23D are standard views of the gaming device base shown in FIG. 22 without front façade, top skin, or bull nose section attached. FIG. 24 is a perspective exploded view of the gaming device base shown in FIGS. 23A-23D. The various parts discussed for FIG. 22 are shown as separate parts.

FIGS. 25A-25D are standard views of a side structure 72 for the gaming device base shown in FIG. 24.

Figure 26D:
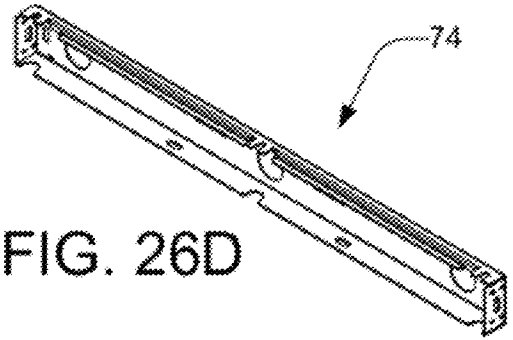
FIGS. 26A-26E are standard views of rear and center cross braces for the gaming device base shown in FIG. 24.
Figure 26E:
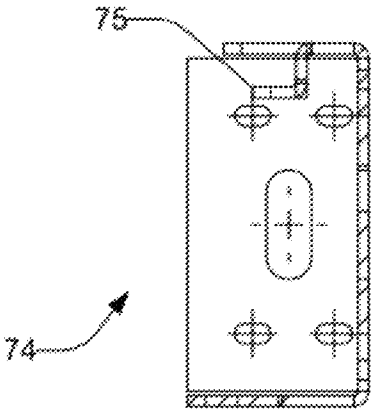
Figure 26C:
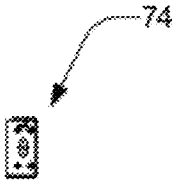
Figure 26B:
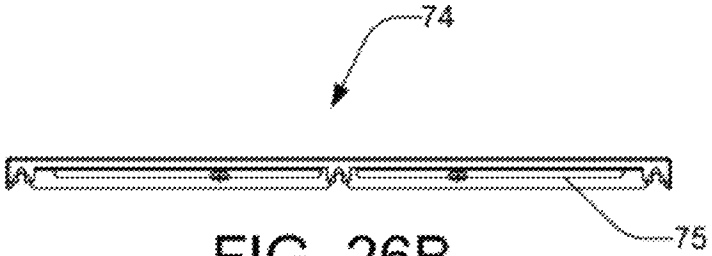
Figure 26A:
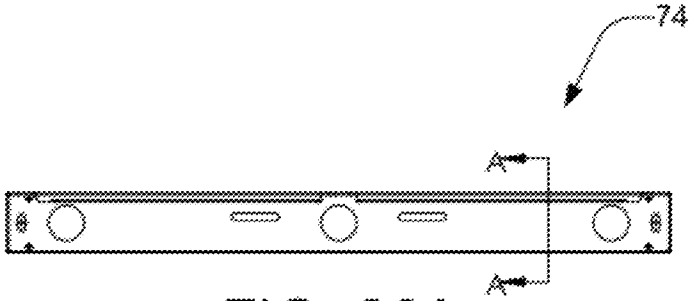

FIGS. 26A-26D are standard views of rear and center cross braces 74 for the gaming device base shown in FIG. 24. FIG. 26E is an enlarged view of FIG. 26C to better shown mounting bracket channels 75 utilized for mounting brackets 90, 91. In this embodiment, three cross braces 74 are installed between the two side structures 72. Each cross brace 74 has a mounting bracket channel 75 to which mounting brackets 90, 91 can be attached and adjusted. The mounting brackets 90, 91 can be installed between the rear and one of the center cross braces 74 and between the other center cross brace 74 and the front channel 76.

Figure 27D:
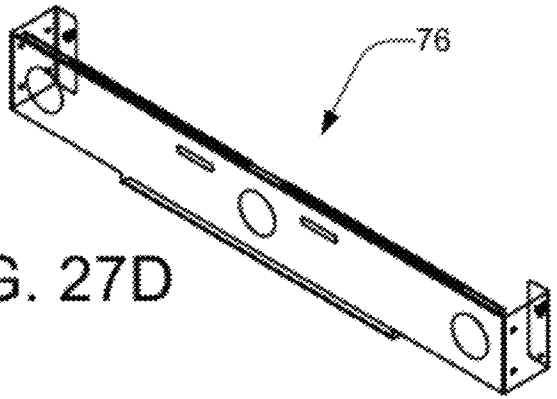
FIGS. 27A-27E are standard views of a front channel for the gaming device base shown in FIG. 24.
Figure 27E:
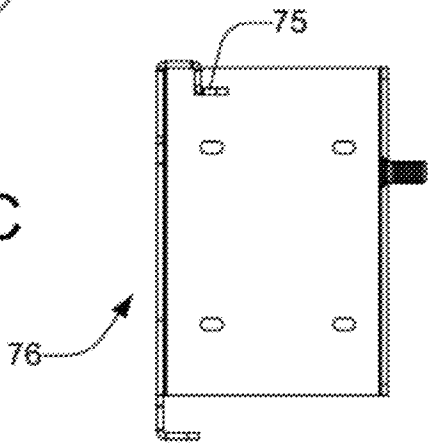
Figure 27C:
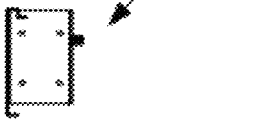
Figure 27B:
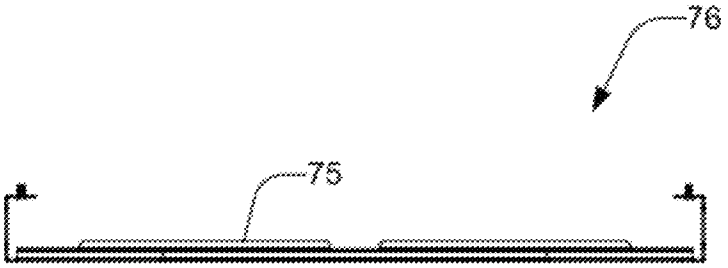
Figure 27A:
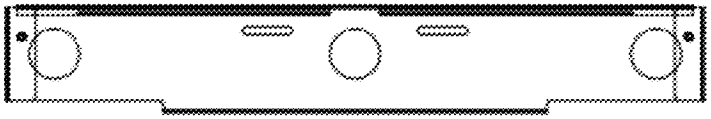
Figure 28D:
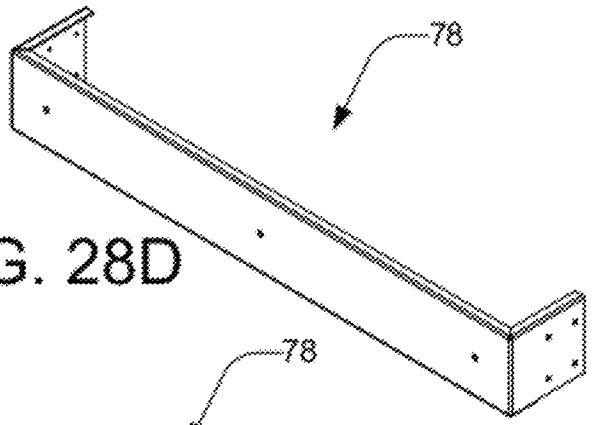
FIGS. 28A-28D are standard views of a bull nose mount for the gaming device base shown in FIG. 24.
Figure 28C:
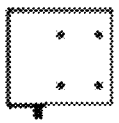
Figure 28B:
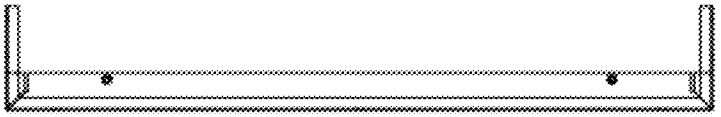
Figure 28A:
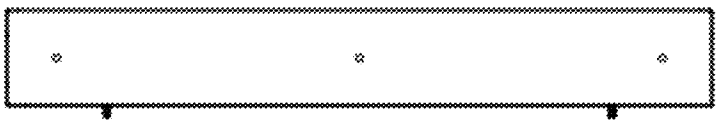
Figure 29D:
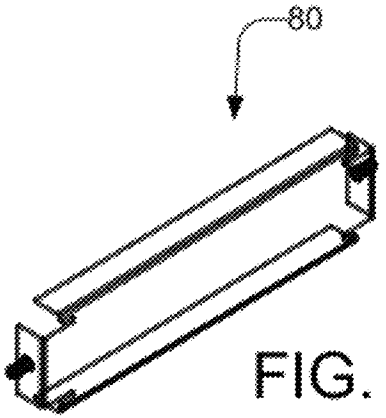
FIGS. 29A-29D are standard views of a center support for the gaming device base shown in FIG. 24.
Figure 29A:
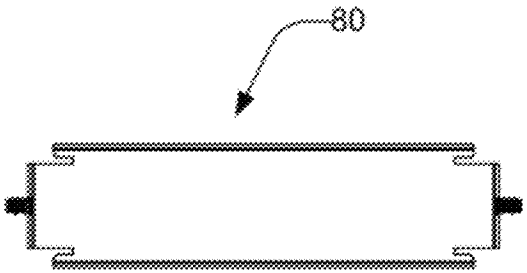
Figure 29B:
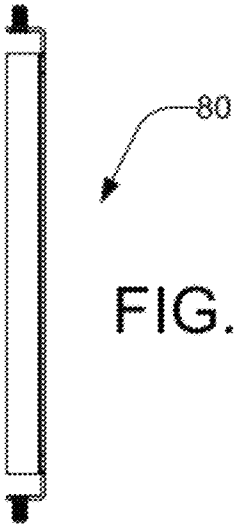
Figure 29C:
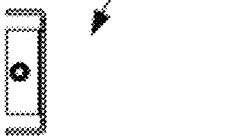
Figure 30D:
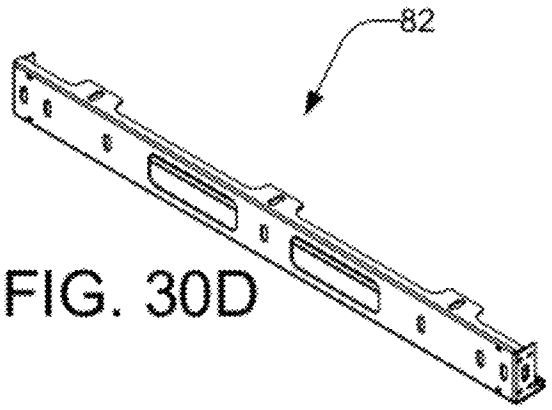
FIGS. 30A-30D are standard views of a horizontal cross member for the gaming device base shown in FIG. 24.
Figure 30C:
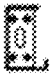
Figure 30B:
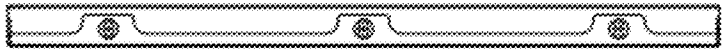
Figure 30A:
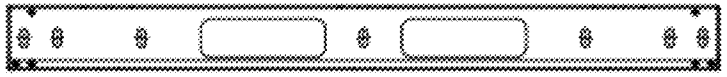
Figure 31D:
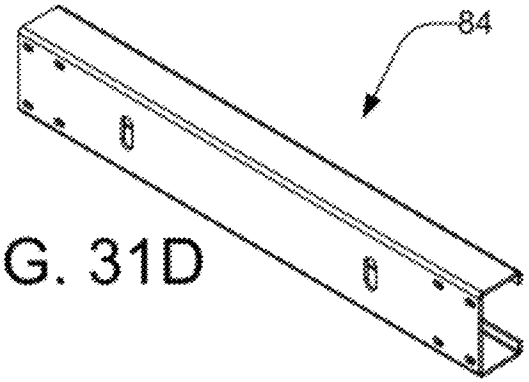
FIGS. 31A-31D are standard views of a horizontal stiffener for the gaming device base shown in FIG. 24.
Figure 31C:
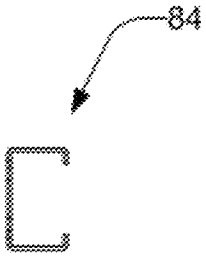
Figure 31B:
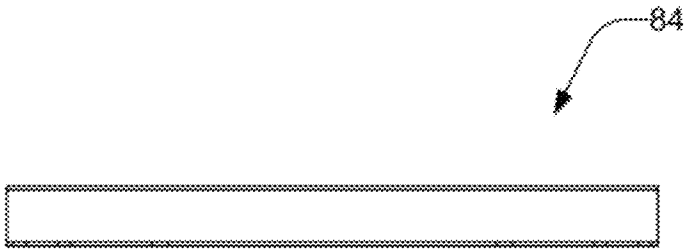
Figure 31A:
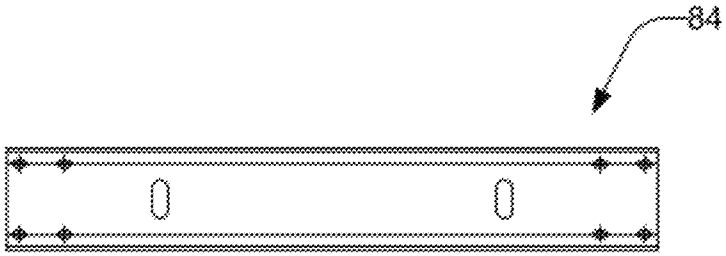
Figure 32D:
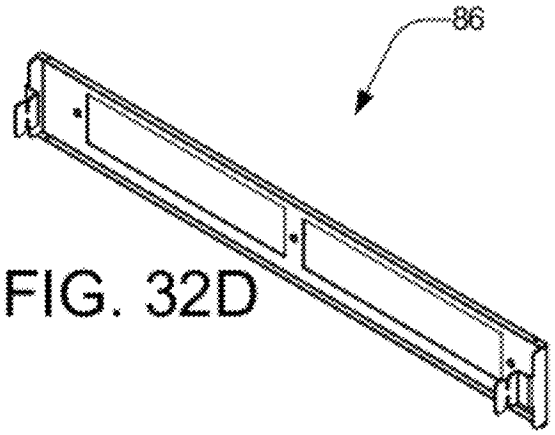
FIGS. 32A-32D are standard views of a bull nose backer for the gaming device base shown in FIG. 24.
Figure 32C:
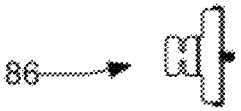
Figure 32B:
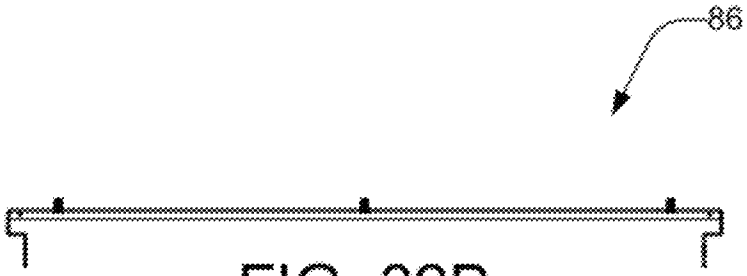
Figure 32A:
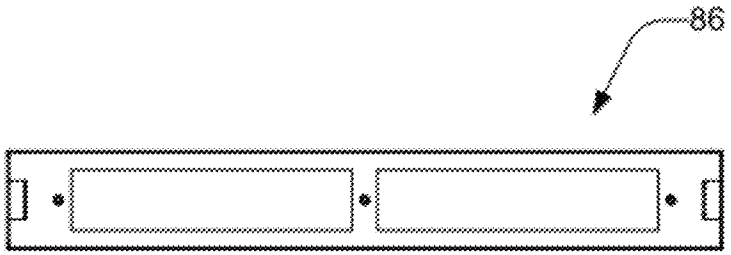
Figure 33D:
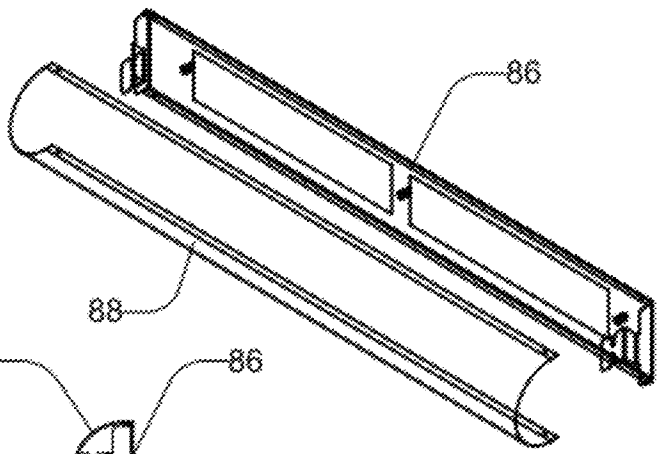
FIGS. 33A-33D are standard views of a bull nose assembly for the gaming device base shown in FIG. 24.
Figure 33C:
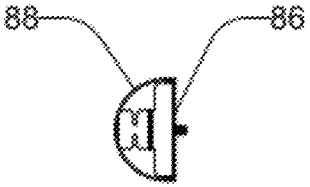
Figure 33B:
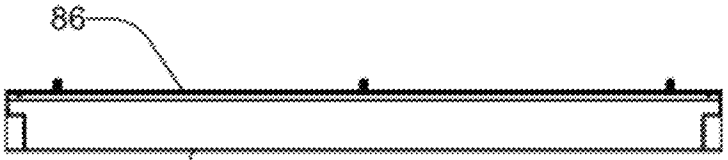
Figure 33A:
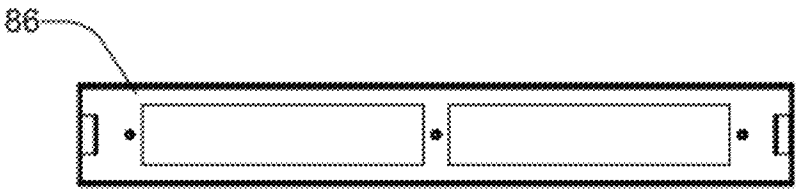

FIGS. 27A-27D are standard views of a front channel 76 for the gaming device base shown in FIG. 24. FIG. 27E is an enlarged view of FIG. 27C to better show the mounting bracket channels 75 utilized for mounting brackets 91. The front channel 76 is installed at the top of the frame in front between the two side structures 72. Longer mounting brackets 91 may be easily inserted, moved, and removed from the mounting bracket channels 75 on the front channel 76 and one of the center cross braces 74.

FIGS. 28A-28D are standard views of a bull nose mount for the gaming device base shown in FIG. 24. The bull nose mount 78 is attached to the front channel 76 and allows for the installation of a bull nose unit (see FIGS. 32A-D and 33A-D).

FIGS. 29A-29D are standard views of a center support for the gaming device base shown in FIG. 24. In this embodiment, two center supports 80 are installed between one of the center cross braces 74 and the front channel 76. The center supports 80 provide additional support to the gaming base frame.

FIGS. 30A-30D are standard views of a horizontal cross member for the gaming device base shown in FIG. 24. Horizontal cross members 82 are installed at the bottom of the frame between the legs of the two side structures 72, and provide additional support and structure to the frame.

FIGS. 31A-31D are standard views of a horizontal stiffener for the gaming device base shown in FIG. 24. In this embodiment, a horizontal stiffener 84 is installed between the legs of each of the side structures 72 to provide additional structure and stiffening to the frame.

FIGS. 32A-32D are standard views of a bull nose backer for the gaming device base shown in FIG. 24. A bull nose backer 86 may be attached to the bull nose mount 78. FIGS. 33A-33D are standard views of a bull nose assembly for the gaming device base shown in FIG. 24. A bull nose is typically a padded hemisphere that attaches to the top of the front of a gaming device base. The bull nose 88 itself attaches to the bull nose backer 86, which in turn is attached to the bull nose mount 78 and front channel 76.

It should be noted that the use of a bull nose is exemplary, and other types of gaming device base fronts are also within the scope of the present invention. Indeed, a bull nose is a part of a façade, and therefore can be easily replaced with another type of gaming device base façade, as disclosed above.

Figure 34:
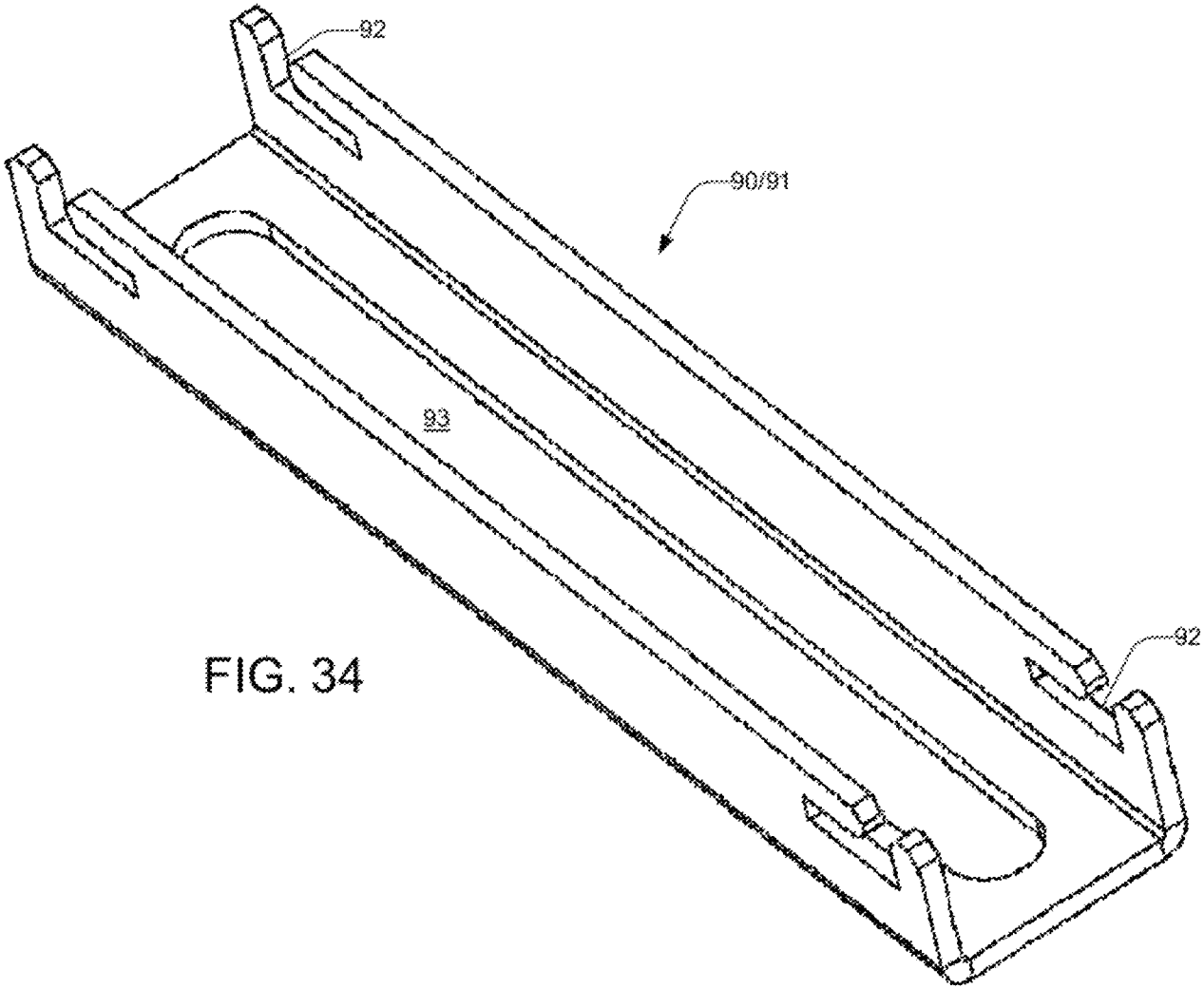
FIG. 34 is a perspective view of a mounting bracket for the gaming device base shown in FIG. 24.
Figure 35D:
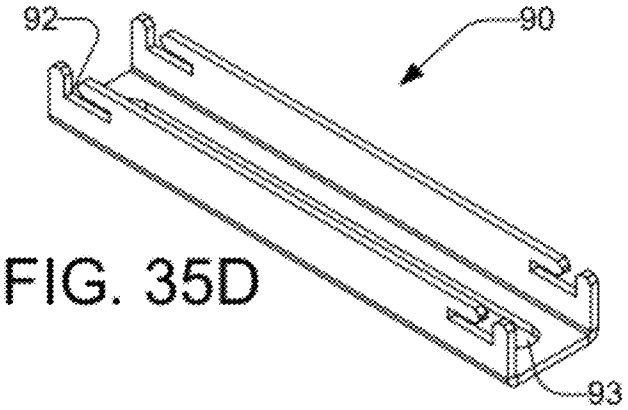
FIGS. 35A-35D are standard views of a short mounting bracket for the gaming device base shown in FIG. 24.
Figure 35C:
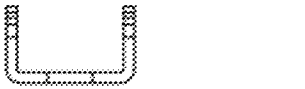
Figure 35B:
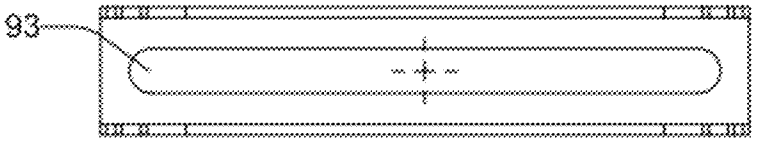
Figure 35A:
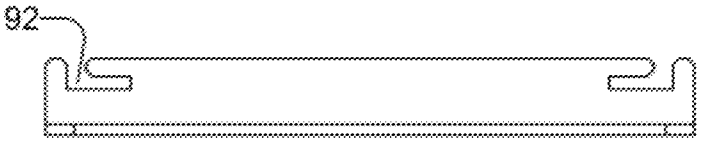
Figure 36D:
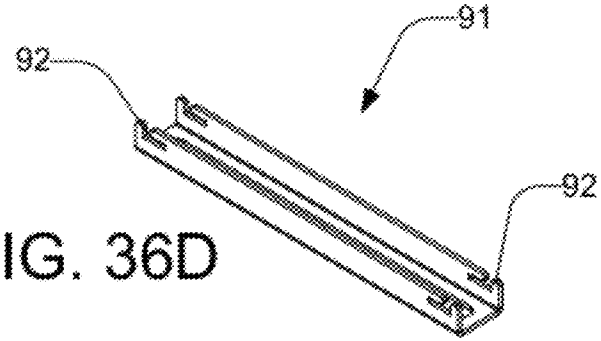
FIGS. 36A-36D are standard views of a long mounting bracket for the gaming device base shown in FIG. 24.
Figure 36C:
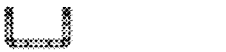
Figure 36B:
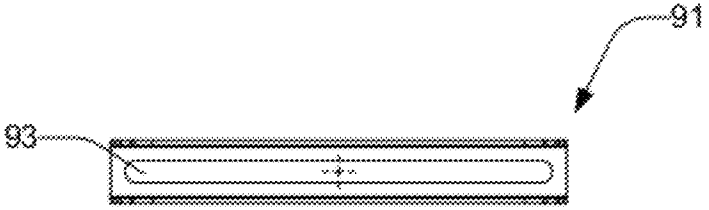
Figure 36A:
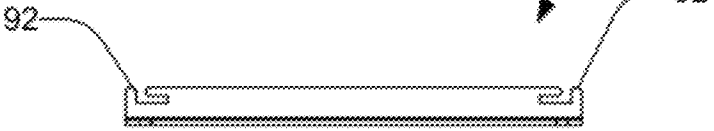

FIG. 34 is a bottom perspective view of a mounting bracket 90, 91 for the gaming device base shown in FIG. 24. FIGS. 35A-35D are standard views of a short mounting bracket 90 for the gaming device base shown in FIG. 24. FIGS. 36A-36D are standard views of a long mounting bracket 91 for the gaming device base shown in FIG. 24. In this embodiment, two different lengths of mounting brackets are utilized. Shorter mounting brackets 90 may be inserted into the mounting bracket channels 75 between the rear and center cross braces 74, while the longer mounting brackets 91 may be inserted into the mounting bracket channels 75 between the center cross braces 74 and the front channel 76.

The mounting brackets 90, 91 consist of a long, thin central portion with a long slot 93 down the center. Bolts 94 from gaming devices may be inserted through the slots 93. The mounting brackets 90, 91 have 90° bends on either side, bending the edges down. Along the two edges at each end of the mounting brackets 90, 91, are channel engagement features 92 that engage mounting bracket channels 75 in the rear and center cross braces 74 and front channel 76. The structure of the slits is such that when the nuts 95 on the bolts 94 from the gaming device inserted through the slots 93 are tight, the mounting brackets 90, 91, are effectively locked into place. However, when a gaming device is not attached through the mounting brackets 90, 91 to the gaming device base 70, the mounting brackets 90, 91 can slide right and left between channels.

Figure 37B:
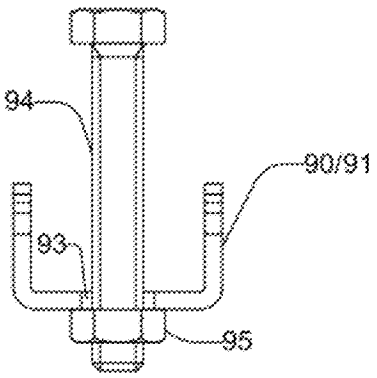
FIG. 37B is a side view and FIG. 37C is a bottom view of a mounting bracket for the gaming device base shown in FIG. 24.
Figure 37C:
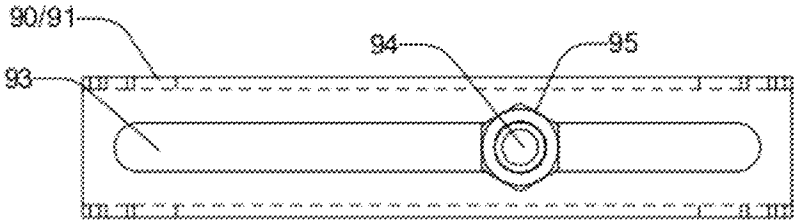
Figure 37A:
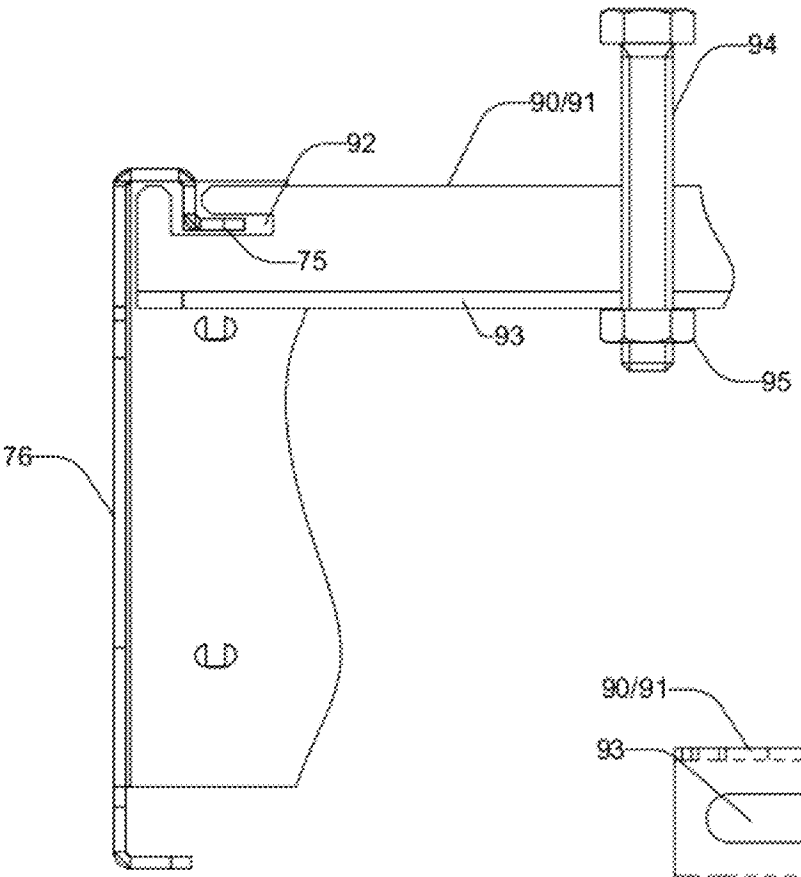
FIG. 37A is a side view of a portion of a mounting bracket installed into a channel in a front channel unit for the gaming device base shown in FIG. 24.
Figure 38A:
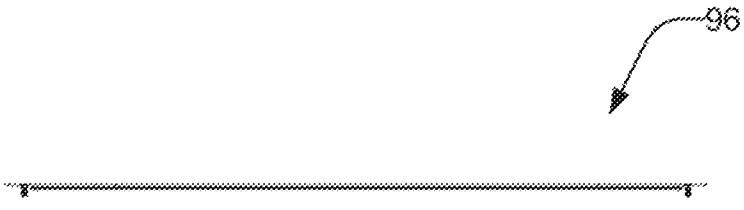
FIGS. 38A-38D are standard views of a top skin assembly for the gaming device base shown in FIG. 24.
Figure 38B:
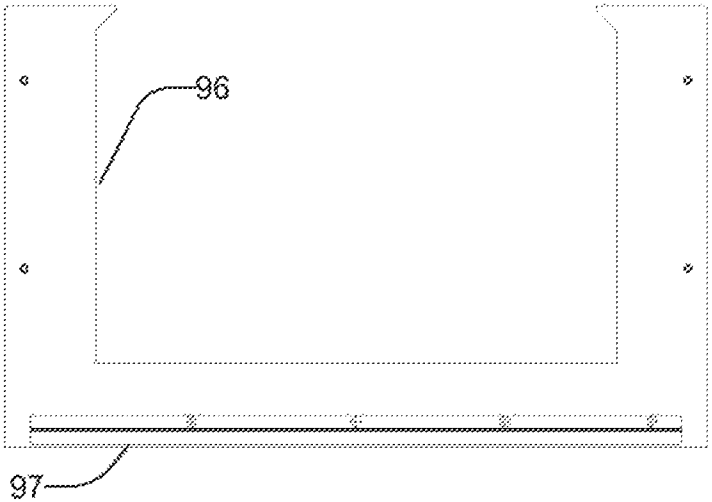
Figure 38C:
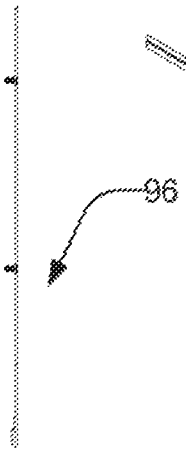
Figure 38D:
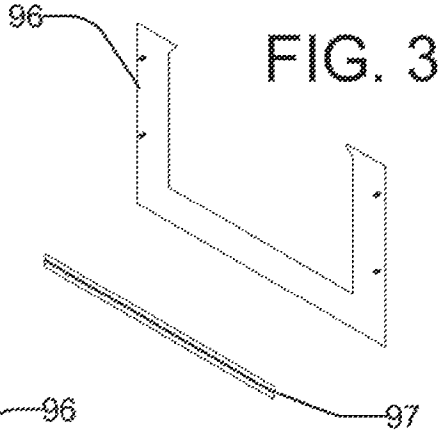
Figure 39D:
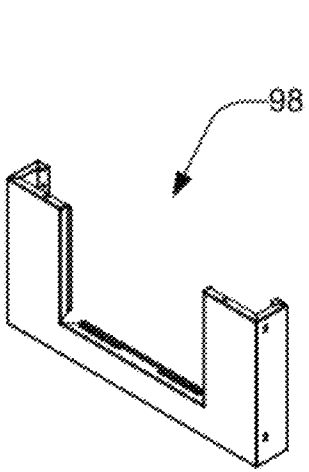
FIGS. 39A-39D are standard views of a front facade for the gaming device base shown in FIG. 24.
Figure 39C:
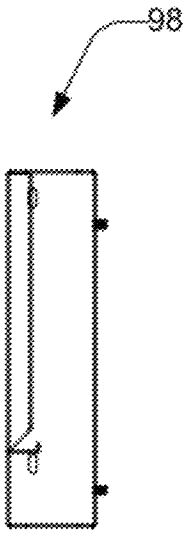
Figure 39B:
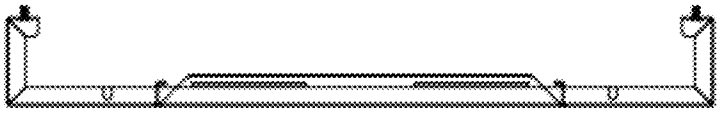
Figure 39A:
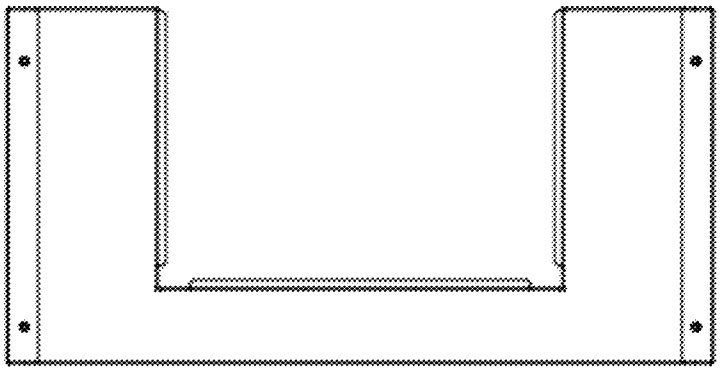

FIG. 37A is a side view of a portion of a mounting bracket 90, 91 installed into a mounting bracket channel 75 in a front channel unit 76 for the gaming device base shown in FIG. 24. The mounting bracket 90, 91 has a "lazy L" shaped channel engagement feature 92 cut into the sides at each end that engages the mounting bracket channels 75 in the front channel unit 76 and cross braces 74. When bolts 94 from gaming devices are inserted through the bolt slot 93, nuts 95 inserted onto the bolts 94, and tightened, the ends of the mounting brackets 90, 91 are forced upwards into the bottom of the top of the mounting bracket channel 75, and the mounting brackets 90, 91 are effectively immobilized. But when there are not bolts 94 with tightened nuts 95 forcing the mounting brackets 90, 91 upwards, there is enough play between the channel engagement feature 92 and the mounting bracket channels 75 that the mounting brackets 90, 91 can slide relatively freely side to side. The structure of the mounting brackets 90, 91 and the mounting bracket channels 95 are exemplary, and other shapes and structures are also within the scope of the present invention.

FIG. 37B is a side view and FIG. 37C is a bottom view of a mounting bracket 90 for the gaming device base shown in FIG. 24. A bolt 94 is shown inserted through the slot 93 in the mounting bracket 90, and a nut 95 has been inserted onto the bolt 94. It should be understood that the bolt 94 will typically be inserted through the base of a gaming device 22 in order to attach it to the gaming device base.

FIGS. 38A-38D are standard views of a top skin assembly for the gaming device base shown in FIG. 24. A top skin may be attached to the top of a gaming device base in order to cover the portion of the top of the base that is not covered by the gaming device itself. The shape of the top skin 96 shown covers the sides and front of the base 70, leaving the rest of the base below the gaming device open. Top skins may be constructed of metal, wood, fiber board, other materials, or combinations thereof.

FIGS. 39A-39D are standard views of a front facade for the gaming device base shown in FIG. 24. Only a single front façade 98 is shown. The front façade has a opening where a door 99 may be installed. Façade components may be constructed from metal, wood, fiber board, other materials, or a combination thereof.

Figure 40:
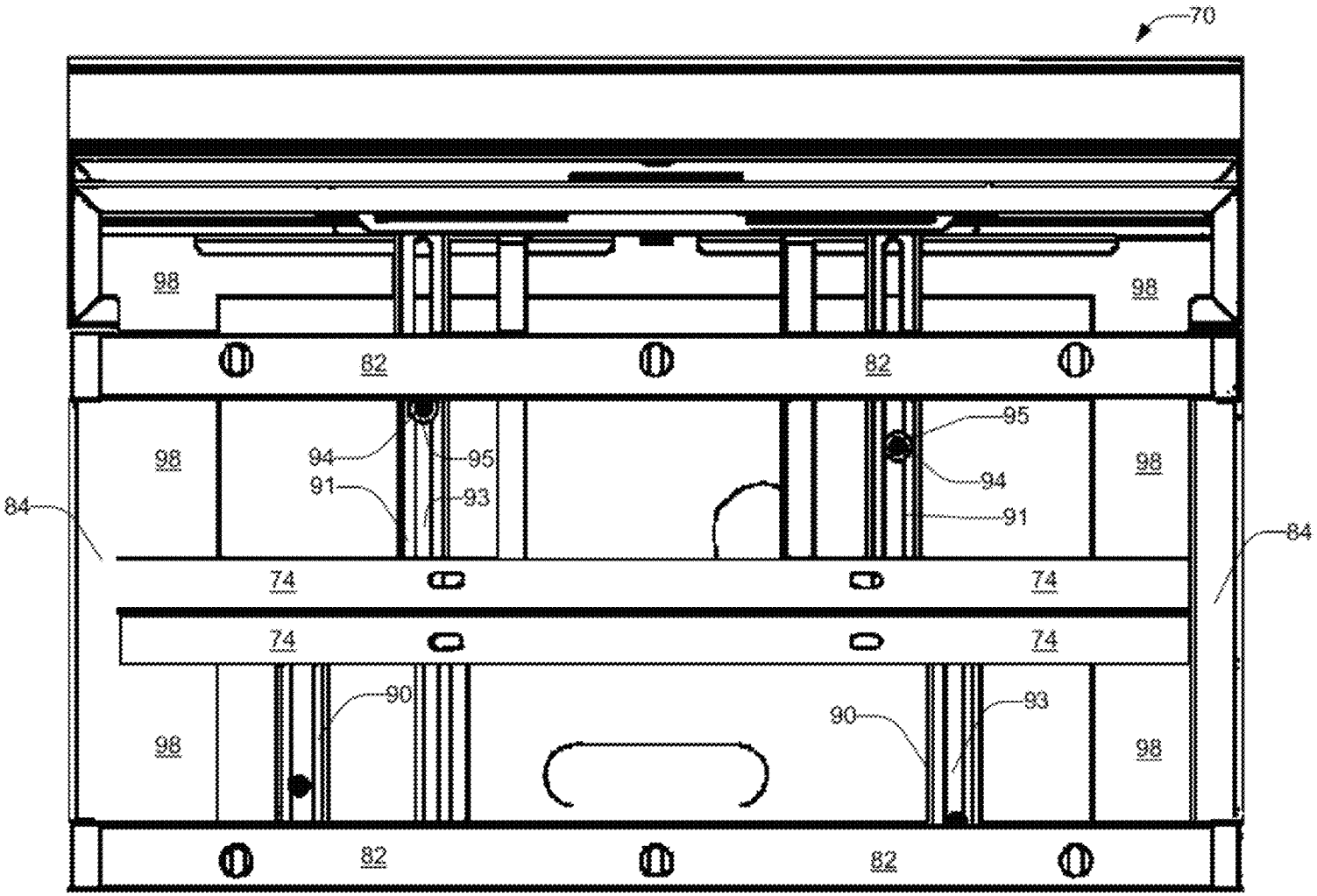
FIG. 40 is a bottom view of the assembled gaming device base shown in FIGS. 21A-21D with a gaming device installed.

FIG. 40 is a bottom view of the assembled gaming device base shown in FIGS. 21A-21D with a gaming device installed. Two shorter mounting brackets 90 and two longer mounting brackets 91 are shown. Bolts 94 from a gaming device have been inserted down through the slots in the mounting brackets 90, 91. Nuts 95 have been inserted onto the bolts 94, securing the gaming device to the mounting brackets 90, 91.

Other methods, designs, and systems for securing different gaming devices to a gaming device base are all within the scope of the present invention. For example, in the disclosed embodiment, mounting brackets 90, 91 may be installed orthogonally to that disclosed herein.

Figure 41B:
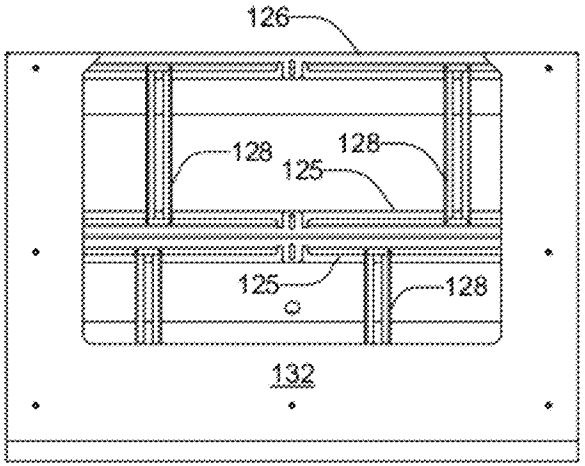
FIGS. 41A-41C are standard views of an exemplary gaming device base with front façade and top skin attached that provides adjustable attachment points, in accordance with another embodiment of the present invention.
Figure 41A:
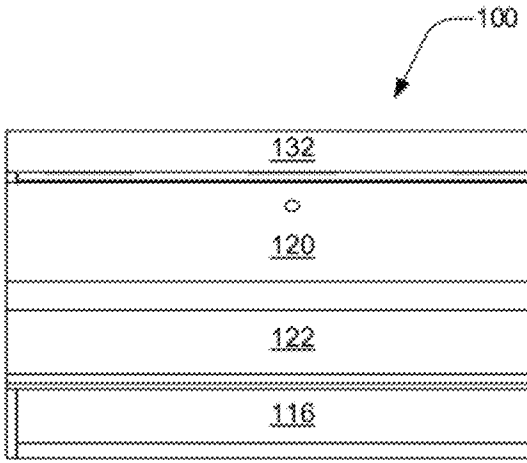
Figure 41C:
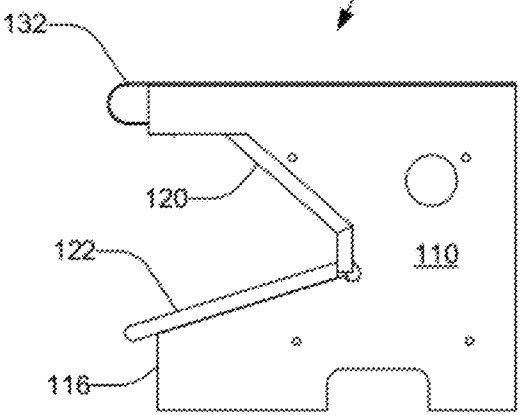

FIGS. 41A-41C are standard views of an exemplary gaming device base 100 with front façade and top skin attached that provides adjustable attachment points, in accordance with another embodiment of the present invention. This is preferably a hybrid gaming device base, primarily constructed from wood or composite, with some metal parts utilized to attach the gaming device to the gaming device base 100. It should be understood that the use of a wood or composite frame and sides, front, and back, are exemplary, and other materials may be utilized. For example, in another embodiment of the present invention utilizes a metal frame with wood or composite sides.

Figure 42:
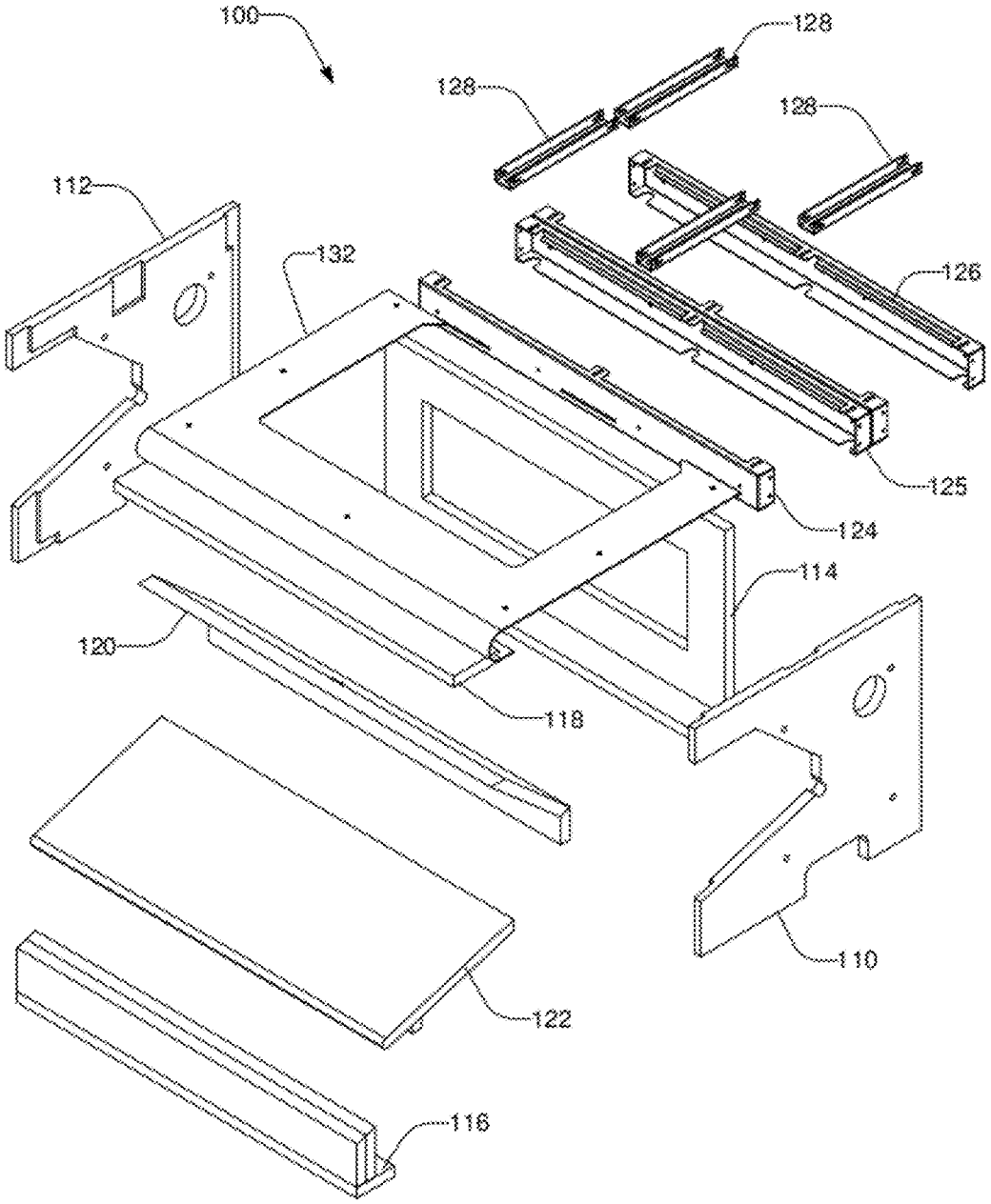
FIG. 42 is a an exploded perspective view of the gaming device base shown in FIG. 41.

FIG. 42 is a an exploded perspective view of the gaming device base shown in FIG. 41. The gaming device base 100 comprises a right side panel 110 and a left side panel 112. Between the right side panel 110 and left side panel 112 are installed: a back plate sub-assembly 114; a toe kick sub-assembly 116; a top door rail 118; a door sub-assembly 120; a platform sub-assembly 122; a horizontal front rail 124; a horizontal center rail assembly 125; and a horizontal back rail 126. The horizontal center rail assembly 125 comprises a pair of horizontal back rails 126 mounted back to back. Inserted on channels between the horizontal front rail 124 and horizontal center rail assembly 125, and between the horizontal center rail assembly 125 and horizontal back rail 126 are a set of slidable mounting brackets 128 to which the gaming device 22 may be attached. A bull-nose top skirt 132 that conforms to the shape of the base of the attached gaming device 22 may be removably attached to the tops of the horizontal front rail 124 and horizontal back rails 126 utilizing studs 102 and locking nuts 103.

The gaming device base 100 is constructed by attaching structural parts to a right side panel 110 and a left side panel 112. Cut-outs 104 are provided on the insides of the right side panel 110 and a left side panel 112 for the back plate sub-assembly 114; toe kick sub-assembly 116; top door rail 118; horizontal front rail 124; horizontal center rail assembly 125; and horizontal back rail 126. Different methods may be utilized to attach these parts, including nails, bolts, and glue.

Figure 43D:
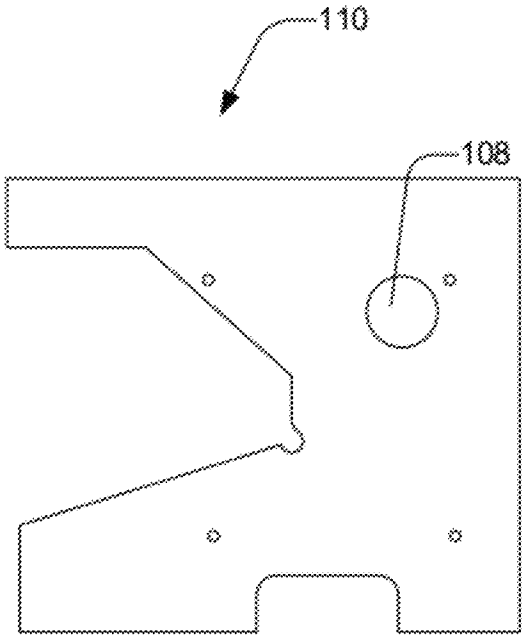
FIGS. 43A, 43C, and 43D are standard views of the right side panel for the gaming device base shown in FIG. 42.
Figure 43C:
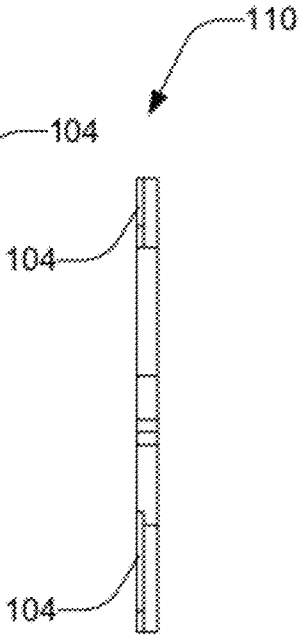
Figure 43A:
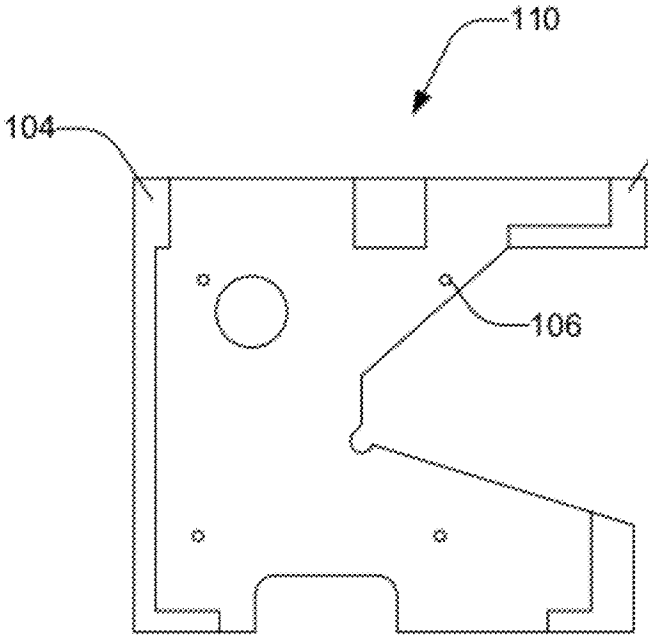

FIGS. 43A, 43C, and 43D are standard views of the right side panel 110 for the gaming device base 100 shown in FIG. 42. FIGS. 44A, 44C, and 44D are standard views of the left side panel 112 for the gaming device base 100 shown in FIG. 42. The right side panel 110 and left side panel 112 are essentially mirror images of each other. In one embodiment of the present invention, they are constructed of wood or composite material. This is exemplary, and other materials are also within the scope of the present invention.

Cut-outs 104 are provided on the insides of the right side panel 110 and a left side panel 112 for the back plate sub-assembly 114; toe kick sub-assembly 116; top door rail 118; horizontal front rail 124; horizontal center rail assembly 125; and horizontal back rail 126. Also shown are bolt holes 106 that may be utilized to attach two gaming device bases 100 together or to attach an end cap or façade (not shown) to the outer sides of single gaming device bases 100 or banks of gaming device bases 100 connected together. Also, on the sides of the right side panel 110 and left side panel 112 are larger openings 108 through which cables can be run between adjacent gaming device bases 100. Other configurations are also within the scope of the present invention.

Figure 45D:
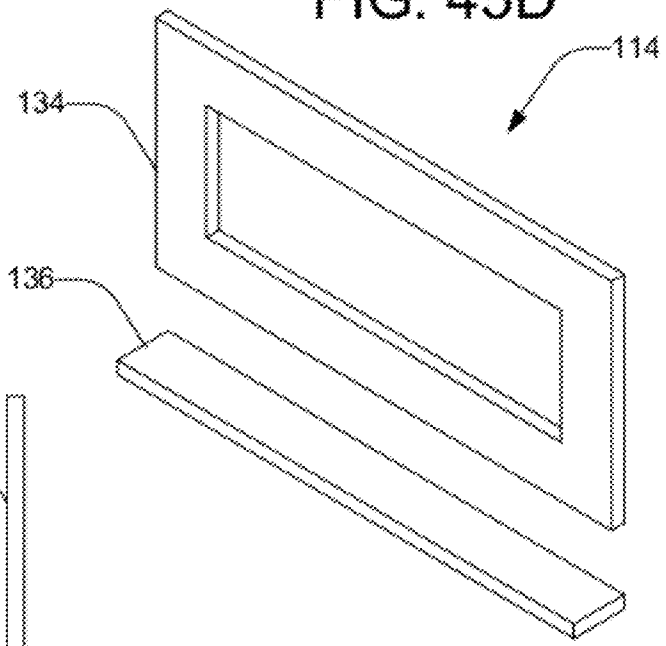
FIGS. 45A, 45C, and 45D are standard views of the back plate assembly for the gaming device base shown in FIG. 42.
Figure 45C:
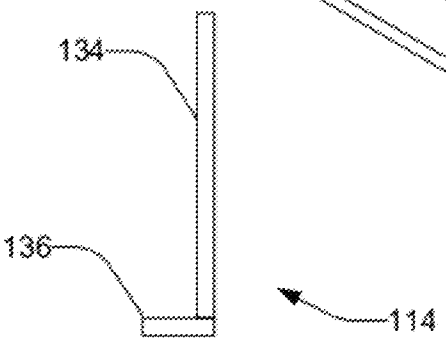
Figure 45A:
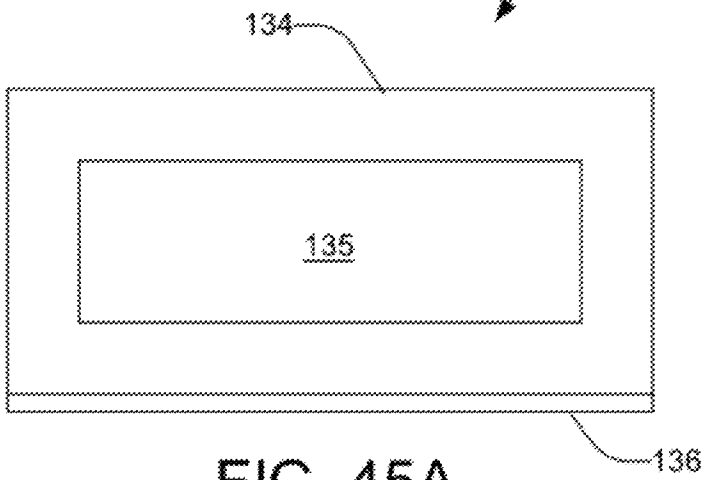

FIGS. 45A, 45C, and 45D are standard views of the back plate sub-assembly 114 for the gaming device base 100 shown in FIG. 42. The back plate sub-assembly 114 has a standard bottom rail 136 mounted horizontally to which is attached a back plate 134 mounted vertically. The back plate 134 has an opening 135 through which cables may be run between gaming device bases 100 mounted back-to-back. Alternatively, the back plate 134 may be covered with a back cap or façade (not shown).

FIGS. 46A, 46C, and 46D are standard views of the toe kick sub-assembly 116 for the gaming device base 100 shown in FIG. 42. The toe kick sub-assembly 116 has a standard bottom rail 136 mounted horizontally, to which is attached a front kick 142 and a back kick 143, both mounted vertically.

Figure 47D:
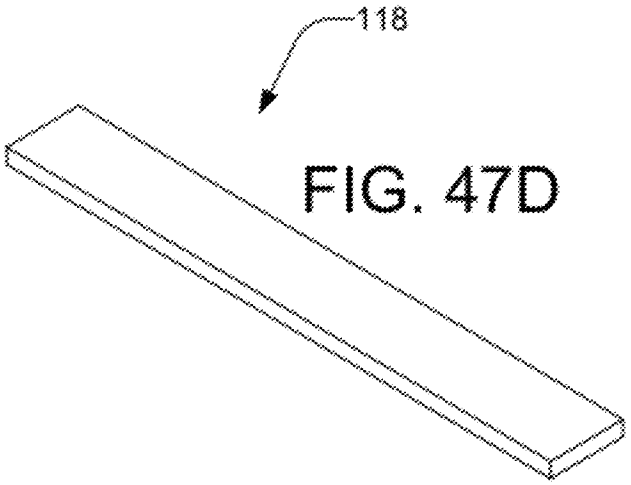
FIGS. 47A, 47B, and 47D are standard views of the top door rail for the gaming device base shown in FIG. 42.
Figure 47B:
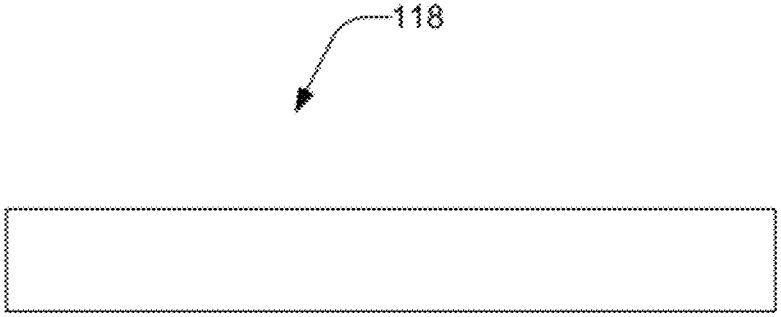
Figure 47A:
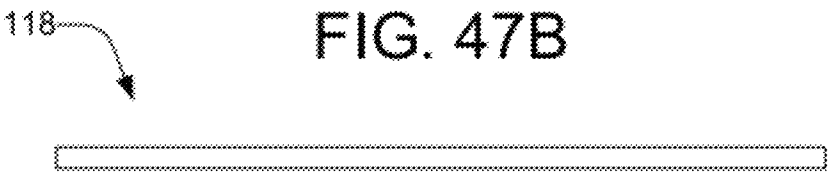

FIGS. 47A, 47B, and 47D are standard views of the top door rail 118 for the gaming device base 100 shown in FIG. 42.

FIGS. 48A, 48C, and 48D are standard views of the door sub-assembly 120 for the gaming device base 100 shown in FIG. 42. In a preferred embodiment, the door has a lock, which allows it to be locked when the gaming device 22 installed on the gaming device base 100 is in use. In one embodiment of the present invention, the door sub-assembly 120 is constructed of wood or composite material. This is exemplary, and other materials are also within the scope of the present invention. The door sub-assembly 120 comprises a door center trim section 138 attached to a door top trim section 140, which may contain a lock (not shown). In one embodiment of the present invention, the door center trim section 138 and door top trim section 140 are mounted at approximately a 130° to conform to the outline of the gaming device base 100.

Figure 49D:
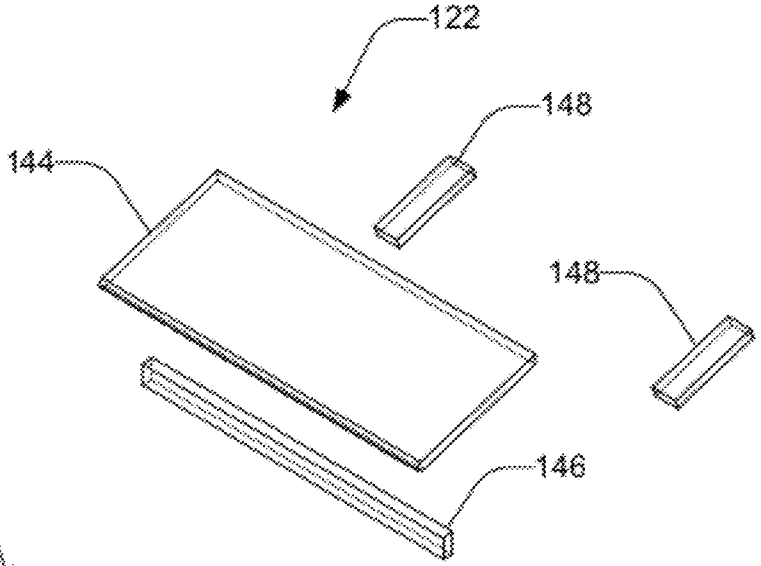
FIGS. 49A, 49C, and 49D are standard views of the platform sub-assembly for the gaming device base shown in FIG. 42.
Figure 49C:
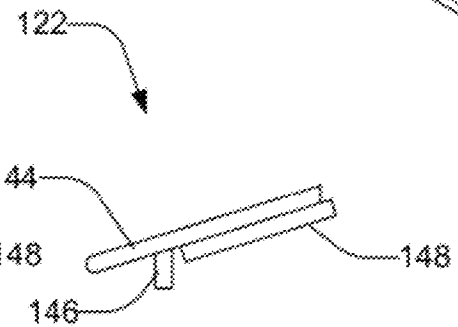
Figure 49A:
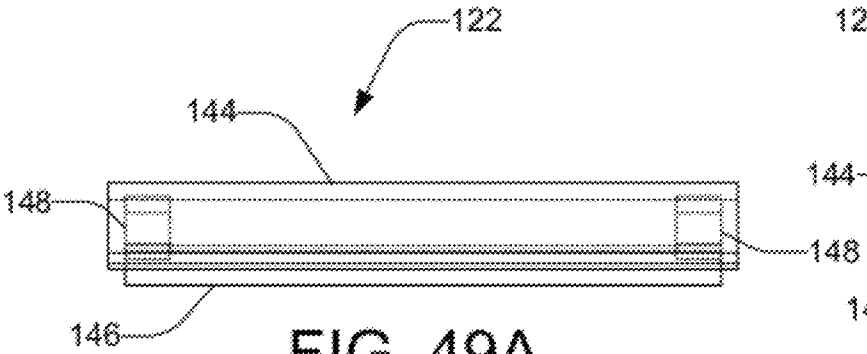

FIGS. 49A, 49C, and 49D are standard views of the platform sub-assembly 122 for the gaming device base 100 shown in FIG. 42. The platform sub-assembly 122 is constructed from a base platform section 144 to which is attached a base platform cleat section 146 and a plurality of footrest runners 148. In one embodiment of the present invention, the base platform section 144 is mounted at approximately a 17° angle, with the base platform cleat section 146 mounted vertically and having a top being cut or formed at that same 17° angle, in order to conform to the shape of the gaming device base 100. The footrest runners 148 are attached to the back or bottom of the base platform section 144. In one embodiment of the present invention, these parts are constructed of wood or composite material. This is exemplary, and other materials are also within the scope of the present invention.

Figure 50D:
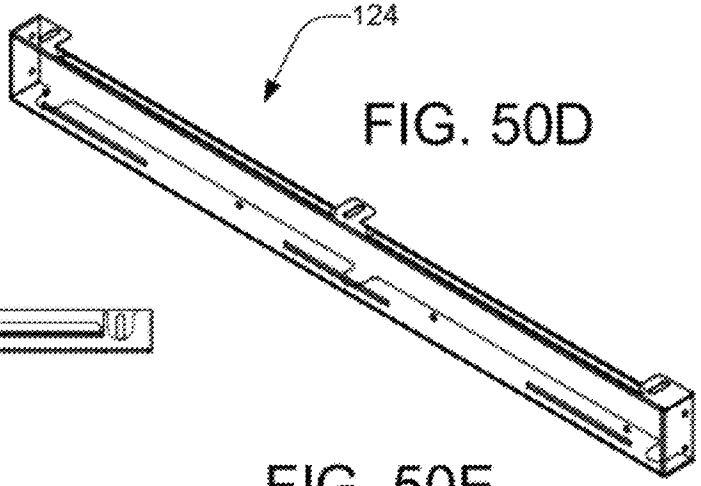
FIGS. 50A-50D are standard views of the horizontal front rail for the gaming device base shown in FIG. 42.
Figure 50E:
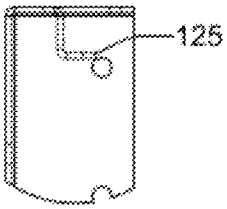
FIG. 50E shows a cross-section of the horizontal front rail taken along the line A-A in FIG. 50A.
Figure 50C:
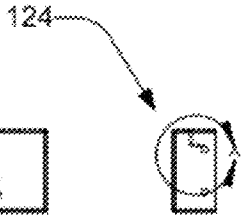
Figure 50B:
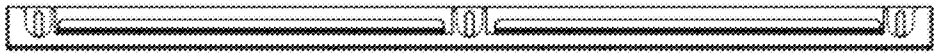
Figure 50A:
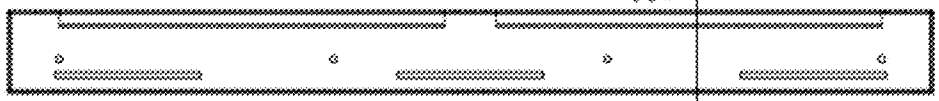
Figure 51D:
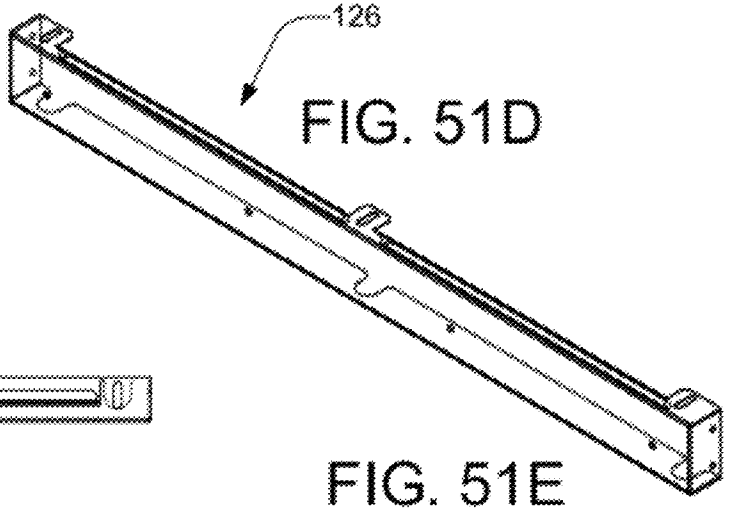
FIGS. 51A-51D are standard views of a horizontal back rail for the gaming device base shown in FIG. 42.
Figure 51E:
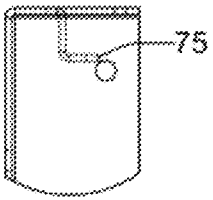
FIG. 51E shows a cross-section of the horizontal back rail taken along the line A-A in FIG. 51A.
Figure 51C:
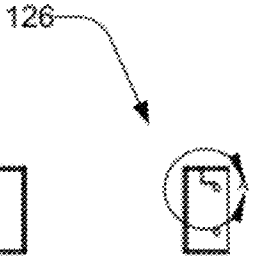
Figure 51B:
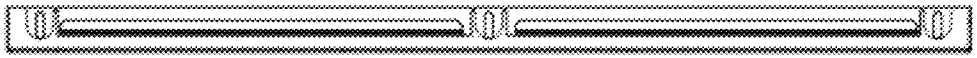
Figure 51A:
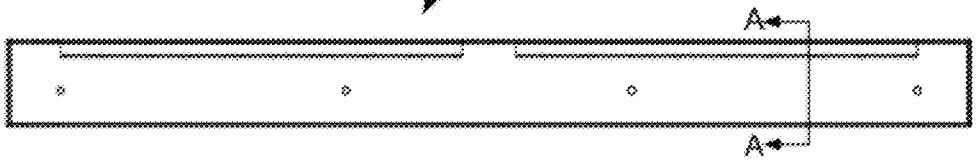

FIGS. 50A-50D are standard views of a horizontal front rail 124 for the gaming device base 100 shown in FIG. 42. FIG. 50E is a cross-sectional view of the horizontal front rail 124 taken along the line A-A in FIG. 50A. The horizontal center rail assembly 125 consists of two horizontal back rails 126 mounted back to back. FIGS. 51A-51D are standard views of a horizontal back rail 126 for the gaming device base 100 shown in FIG. 42. FIG. 51E is a cross-sectional view of horizontal back rail 126 taken along the line A-A in FIG. 51A. The rails 124, 126 are spaced apart and have channels that are designed to interact with the slidable mounting brackets 128 as shown in FIGS. 37A-37C. The mounting brackets 128 can easily slide back and forth along the rails in order to accommodate different gaming machines with different bolt hole configurations. The mounting brackets can then be immobilized by inserting nuts onto the bolts and tightening the nuts against the mounting brackets. Mounting brackets 128 may also be added or removed, as required, through a gap in the channels on the rails 124, 126.

Figures 52A, 52C, 52D:
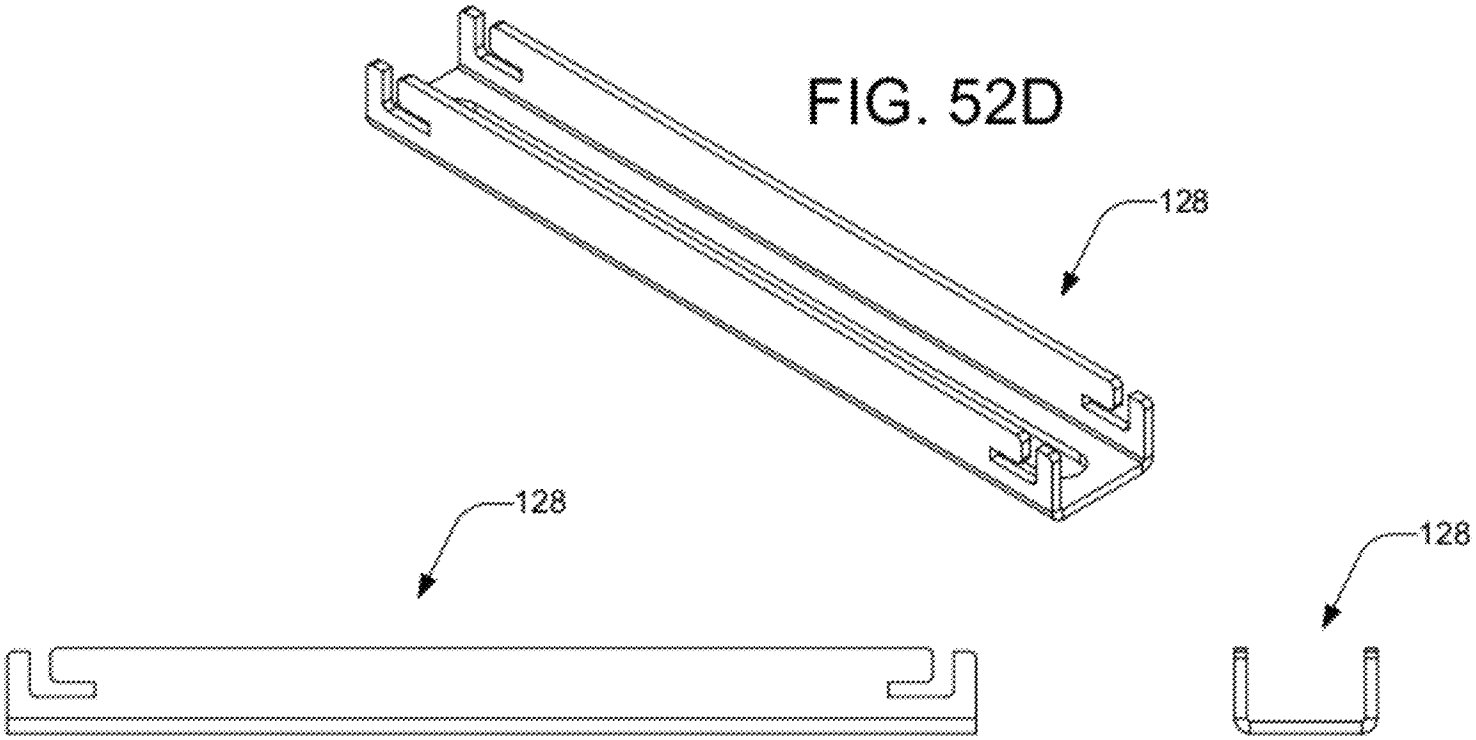
FIGS. 52A, 52C, and 52D are standard views of a slidable mounting bracket for the gaming device base shown in FIG. 42.
Figure 53D:
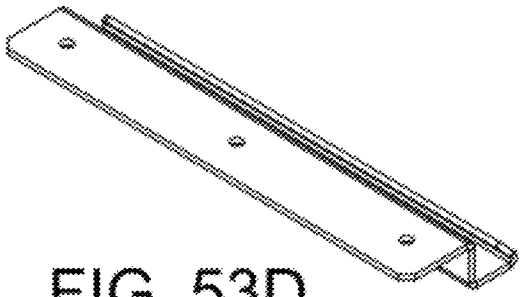
FIGS. 53A-53D are standard views of an offset cam stop for the gaming device base shown in FIG. 42.
Figure 53C:
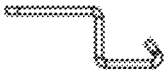
Figure 53B:
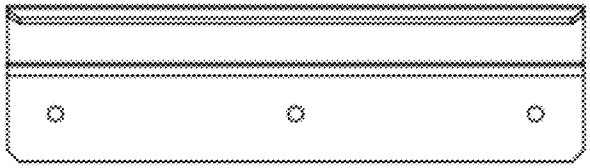
Figure 53A:
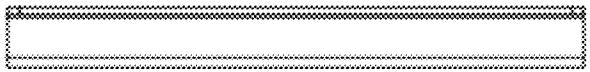
Figure 54E:
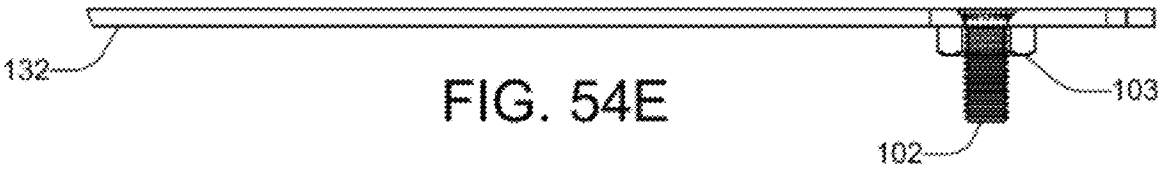
FIGS. 54A-54E are standard views of the top skin for the gaming device base shown in FIG. 42.
Figure 54D:
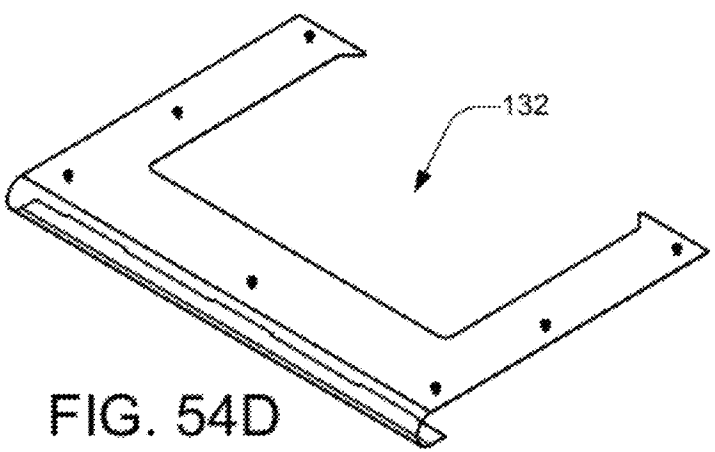
Figure 54C:
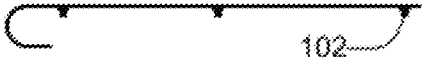
Figure 54B:
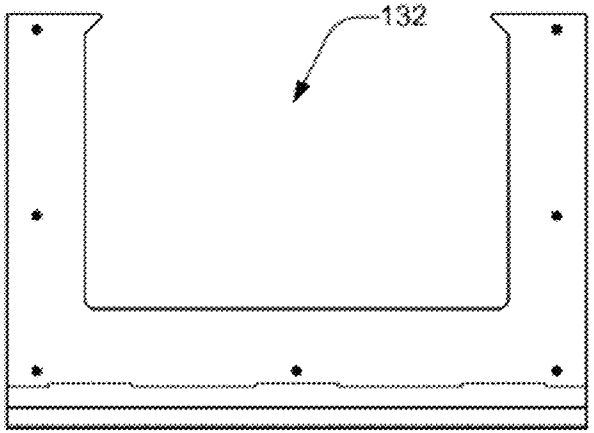
Figure 54A:
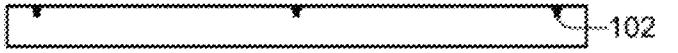

FIGS. 52A, 52C, and 52D are standard views of a slidable mounting bracket 128 for the gaming device base 100 shown in FIG. 42. The slidable mounting brackets 128 are sized to fit between the channels on the horizontal front rail 124 and the center rail assembly 125 and between the center rail assembly 125 and the horizontal back rail 126. These mounting brackets 128 are identical in function to the mounting brackets 90, 91, as shown in FIGS. 34, 35A-35D, 36A-36D, and 40, and are utilized to attach a gaming device 22 to the gaming device base 100 as shown in FIGS. 37A-37C. The mounting brackets 128 are 12 gauge plated steel in one embodiment of the present invention. This is exemplary, and other materials are also within the scope of the present invention.

FIGS. 53A-53D are standard views of the offset cam stop 130 for the gaming device base 100 shown in FIG. 42.

FIGS. 54A-54D are standard views of the top skin 132 for the gaming device base 100 shown in FIG. 42. This is similar to the top skin 96 shown in FIGS. 38A-38D. The top skins 96, 132, have different sized openings to accommodate different sizes of gaming devices, and when the gaming device 22 on a gaming device base 70, 100 is replaced, it may be necessary to replace the top skins 96, 132, depending on the size of the base of the new gaming device 22 being installed. In one embodiment of the present invention, the top skin 132 is constructed from metal, such as 14 gauge steel, and then given a desired color and look through standard manufacturing techniques such as spray paint. This is exemplary, and other materials and techniques for coloring and providing a desired look are also within the scope of the present invention.

FIG. 45E is a partial side view of the top skin 132 shown in FIGS. 54A-54D that shows the studs 102 and lock nuts 103 used to removably attach the top skin 132 to the tops of the horizontal front rail 124 and horizontal back rails 126, and, thence to the gaming device base 100.

In one embodiment of the present invention, the right side panel 110, left side panel 112, back plate sub-assembly 114; toe kick sub-assembly 116, top door rail 118, a door sub-assembly 120, and a platform sub-assembly 122 are constructed from ¾" plywood. The horizontal front rail 124, horizontal back rails 126, and offset cam stop 130 are constructed from 16 gauge steel, and the slidable mounting brackets 128 are constructed from 12 gauge steel. This is exemplary, and other materials are also within the scope of the present invention.

Those skilled in the art will recognize that modifications and variations can be made without departing from the spirit of the invention. Therefore, it is intended that this invention encompass all such variations and modifications as fall within the scope of the appended claims.

What is claimed is:

1. A gaming device mounting system, the system comprising:

a gaming device support structure; and a plurality of slidable mounting brackets, each slidable mounting bracket having at least a first end slidably coupled to the gaming device support structure, wherein the slidable mounting brackets are, with the first end of each slidable mounting bracket remaining slidably coupled to the gaming device support structure, slidable to accommodate a plurality of varying configurations of attachment mechanisms disposed on a plurality of different gaming devices each having a betting media insertion slot.

2. The gaming device mounting system of claim 1, wherein the attachment mechanisms of the different gaming devices include bolts and each slidable mounting bracket includes a hole that accommodates one or more of the bolts.

3. The gaming device mounting system of claim 2, wherein the slidable mounting brackets slide in a direction parallel to a floor surface.

4. The gaming device mounting system of claim 1, further including a footrest coupled to the gaming device support structure.

5. The gaming device mounting system of claim 1, wherein a door is coupled to the gaming device support structure.

6. A method of supporting a gaming device having a plurality of attachment mechanisms disposed in a configuration, the method comprising:

providing a gaming device support structure having a plurality of slidable mounting brackets, each slidable mounting bracket having at least a first end slidably coupled to the gaming device support structure, wherein the slidable mounting brackets are, with the first end of each slidable mounting bracket remaining slidably coupled to the gaming device support structure, slidable to accommodate a plurality of varying configurations of attachment mechanisms disposed on a plurality of different gaming devices each having a betting media insertion slot;

sliding at least one of the slidable mounting brackets such that the plurality of mounting brackets collectively accommodate the configuration of attachment mechanisms of a first gaming device from among the plurality of different gaming devices when the first gaming device is positioned upon the gaming device support structure;

positioning the first gaming device upon the gaming device support structure; and attaching the attachment mechanisms of the first gaming device to the slidable mounting brackets of the gaming device support structure.

7. The method of claim 6, wherein the attachment mechanisms of the first gaming device include bolts and each slidable mounting bracket includes a hole that accommodates one or more of the bolts.

8. The method of claim 6, further comprising:

removing the first gaming device from the gaming device support structure;

providing a second gaming device from among the plurality of different gaming devices having a plurality of attachment mechanisms disposed in a configuration different from the configuration of the attachment mechanisms of the first gaming device;

sliding at least one of the slidable mounting brackets of the gaming device support structure such that the plurality of slidable mounting brackets collectively accommodate the configuration of attachment mechanisms of the second gaming device when the second gaming device is positioned upon the gaming device support structure;

positioning the second gaming device upon the gaming device support structure; and attaching the attachment mechanisms of the second gaming device to the slidable mounting brackets of the gaming device support structure.

9. The method of claim 6, wherein a footrest is coupled to the gaming device support structure.

10. The method of claim 6, wherein a door is coupled to the gaming device support structure.

11. A slot machine base, the base comprising:

a slot machine support structure; and a plurality of slidable mounting brackets positioned on the slot machine support structure, each slidable mounting bracket having a first end in slidable contact with the slot machine support structure and a second end in slidable contact with the slot machine support structure, wherein the slidable mounting brackets are, while remaining positioned on the slot machine support structure, slidable to accommodate a plurality of varying configurations of attachment mechanisms disposed on a plurality of different slot machines.

12. The slot machine base of claim 11, further including a footrest coupled to the slot machine support structure.

13. The slot machine base of claim 11, further including a door coupled to the slot machine support structure.

14. The slot machine base of claim 11, wherein the plurality of slidable mounting brackets are slidable in a common direction.

15. The slot machine base of claim 11, wherein the plurality of slidable mounting brackets are slidable within a common plane.

16. A slot machine base, the base comprising:

a slot machine support structure; and a plurality of slidable mounting brackets slidably positioned on the slot machine support structure, wherein the slidable mounting brackets each have at least one hole, are adapted to provide support to a slot machine, and are, while remaining slidably positioned on the slot machine support structure, slidable such that the at least one hole is capable of corresponding to at least one attachment mechanism of any of a plurality of different configurations of attachment mechanisms disposed on a plurality of different slot machines.

17. The slot machine base of claim 16, wherein the plurality of slidable mounting brackets are slidable in a common direction.

18. The slot machine base of claim 16, wherein the plurality of slidable mounting brackets are slidable within a common plane.

19. A slot machine base, the base comprising:

a slot machine support structure, the slot machine support structure including at least one channel; and at least one slidable member slidably coupled to the channel, wherein the slidable member has at least one hole, is adapted to provide support for a slot machine, and is, while remaining slidably coupled to the channel, slidable such that the at least one hole is capable of corresponding to at least one bolt of any of a plurality of different configurations of bolts disposed on a plurality of different slot machines.

20. The slot machine base of claim 19, wherein the slidable member is slidable in a direction parallel to a floor surface.

* * * * *